US007027010B2

(12) United States Patent
Lee

(10) Patent No.: US 7,027,010 B2
(45) Date of Patent: Apr. 11, 2006

(54) PLASMA DISPLAY PANEL, AND APPARATUS AND METHOD FOR DRIVING THE SAME

(75) Inventor: Jun-Young Lee, Cheonan (KR)

(73) Assignee: Samsung SDI Co., Ltd., Suwon (KR)

( * ) Notice: Subject to any disclaimer, the term of this patent is extended or adjusted under 35 U.S.C. 154(b) by 227 days.

(21) Appl. No.: 10/200,486

(22) Filed: Jul. 23, 2002

(65) Prior Publication Data

US 2003/0080925 A1 May 1, 2003

(30) Foreign Application Priority Data

Oct. 29, 2001 (KR) ..... 2001-66861

(51) Int. Cl.
*G09G 5/00* (2006.01)

(52) U.S. Cl. ..... 345/60; 315/169.3

(58) Field of Classification Search ..... 345/60, 345/68–70, 37, 41, 42; 315/16.5, 169.1, 315/169.4, 169.3
See application file for complete search history.

(56) References Cited

U.S. PATENT DOCUMENTS 4,958,105 A * 9/1990 Young et al. ..... 315/169.3
5,081,400 A * 1/1992 Weber et al. ..... 315/169.4
5,642,018 A * 6/1997 Marcotte ..... 315/169.4
5,745,086 A 4/1998 Weber
6,011,355 A * 1/2000 Nagai ..... 345/60
6,175,192 B1 * 1/2001 Moon ..... 315/169.4
6,633,287 B1 * 10/2003 Yatabe et al. ..... 345/211
6,646,387 B1 * 11/2003 Chae et al. ..... 315/165
6,674,417 B1 * 1/2004 Hsu et al. ..... 345/60
2003/0137472 A1 * 7/2003 Schermerhom ..... 345/60

FOREIGN PATENT DOCUMENTS

EP 1 065 650 A2 1/2001
WO WO 99/12149 3/1999

* cited by examiner

*Primary Examiner*—Amare Mengistu
(74) *Attorney, Agent, or Firm*—HC Park & Associates, PLC

(57) ABSTRACT

A PDP driving apparatus includes a sustain discharge unit including a first switch and a second switch connected between a first voltage and second voltage and having a contact connected to one terminal of a panel capacitor, and a third switch and a fourth switch connected between the voltages and having a contact connected to other terminal of the panel capacitor, for maintaining either terminal voltage at the first voltage or the second voltage; and a charge/discharge unit including a first inductor and a second inductor connected to the terminals of the panel capacitor, for boosting a current to a level to store energy in the first inductor and the second inductor while either terminal voltage of the panel capacitor is maintained at the sustain discharge voltage, and inverting the polarity of either terminal voltage using the stored energy.

31 Claims, 19 Drawing Sheets

Mode 1

Mode 2

Mode 3

Mode 4

Mode 5

Mode 6

Mode 7

Mode 8

(V2<Vs/2, V4<Vs/2)

(V2>Vs/2, V4>Vs/2)

PLASMA DISPLAY PANEL, AND APPARATUS AND METHOD FOR DRIVING THE SAME

CROSS REFERENCE TO RELATED APPLICATIONS

This application claims priority of Korean Patent Application Number 200 1-066861 filed in the Korean Intellectual Property Office on Oct. 29, 2001, the disclosure of which is herein incorporated by reference.

BACKGROUND OF THE INVENTION (a) Field of the Invention

The present invention relates to a plasma display panel (PDP) and an apparatus and method for driving the same. More specifically, the present invention relates to an energy recovery circuit and a method for driving the same that directly contribute to plasma display discharge.

(b) Description of the Related Art

In recent years, flat panel displays such as liquid crystal displays (LCD), field emission displays (FED), PDPs, and the like have been actively developed. The PDP has advantages over the other flat panel displays because of its high luminance, high luminous efficiency, and wide view angle. Accordingly, the PDP is a preferred large-scale screen of larger than 40 inches that can substitute for the conventional display.

The PDP is a flat panel display that uses plasma generated by gas discharge to display characters or images. It includes, depending on its size, more than several scores to millions of pixels arranged in a matrix pattern. Such a PDP is classified as a direct current (DC) type or an alternating current (AC) type according to its discharge cell structure and the waveform of the driving voltage applied thereto.

The DC type PDP has electrodes exposed to a discharge space to allow DC to flow through the discharge space while the voltage is applied, and thus requires a resistance for limiting the current. To the contrary, the AC type PDP has electrodes covered with a dielectric layer that forms a capacitor to limit the current and protect the electrodes from the impact of ions during discharge. Thus, the AC type PDP has a longer lifetime than the DC type PDP.

FIG. 1 is a partial perspective view of an AC type PDP.

Referring to FIG. 1, on a first glass substrate 1 are arranged in parallel pairs of scan electrodes 4 and sustain electrodes 5 that are covered with a dielectric layer 2 and a protective layer 3. On a second glass substrate 6 are arranged a plurality of address electrodes 8 covered with an insulating layer 7. Barrier ribs 9 are formed in parallel with the address electrodes 8 on the insulating layer 7, which is interposed between the address electrodes 8. A fluorescent material 10 is formed on the surface of the insulating layer 7 and on both sides of the barrier ribs 9. The first and second glass substrates 1 and 6 are arranged face-to-face with a discharge space 11 formed therebetween, and the scan electrodes 4 and the sustain electrodes 5 lie normal to the address electrodes 8. The discharge space at the intersection between the address electrode 8 and the pair of scan electrode 4 and sustain electrode 5 forms a discharge cell 12.

FIG. 2 shows an arrangement of electrodes in the PDP.

Referring to FIG. 2, the PDP has a pixel matrix consisting of m×n discharge cells. In the PDP, address electrodes $A_1$ to $A_m$ are arranged in columns and scan electrodes $Y_1$ to $Y_n$ and sustain electrodes $X_1$ to $X_n$ are alternately arranged in rows. Discharge cells 12 shown in FIG. 2 correspond to the discharge cells 12 in FIG. 1.

Typically, the driving method of the AC type PDP is composed of a reset (initialization) step, a write (addressing) step, a sustain step, and an erase step.

In the reset step, the state of each cell is initialized to be ready for addressing the cell. In the write step, wall charges are applied in a selected cell that is on the panel (i.e., addressed cell). In the sustain step, a discharge occurs to actually display an image on the addressed cells. In the erase step, the wall charges on the cells are erased to finish the sustained discharge.

In the AC type PDP, the scan electrodes (hereinafter, referred to as "Y electrodes") and the sustain electrodes (hereinafter, referred to as "X electrodes") for the sustain discharge act as a capacitive load, so that there is a capacitance for the electrodes and a need for a reactive power as well as a power for a discharge. A circuit for recovering the reactive power and reusing it is called an "energy recovery circuit (or a sustain discharge circuit)".

A conventional energy recovery circuit for the AC type PDP and its driving method are now described.

FIGS. 3 and 4 show a conventional energy recovery circuit and its waveform diagram, respectively.

FIG. 3 shows the energy recovery circuit disclosed in the U.S. Pat. Nos. 4,866,349 and 5,081,400 issued to L. F. Weber. The driver circuit for the AC type PDP includes an energy recovery circuit 30 of X electrodes that has the same configuration as an energy recovery circuit 31 (not shown) of Y electrodes. Expediently, the energy recovery circuit for one electrode will be described hereinafter.

The conventional energy recovery circuit 30 includes an energy recovery unit that comprises two switches $S_a$ and $S_b$, diodes $D_1$ and $D_2$, an inductor $L_c$ and an energy recovery capacitor $C_c$, and a sustain discharge unit that comprises two serially connected switches $S_c$ and $S_d$.

A contact between the two switches $S_c$ and $S_d$ of the sustain discharge unit is coupled to the PDP, which is represented by a capacitor $C_P$ in an equivalent circuit.

The conventional energy recovery circuit as constructed above operates in four modes according to the states of the switches $S_a$ to $S_d$, and shows the waveforms of output voltage $V_P$ and current $I_L$ flowing to the inductor $L_C$, as illustrated in FIG. 4.

The switch $S_d$ is initially ON before the switch $S_a$ is turned ON, so that the terminal voltage $V_P$ of the panel is at zero. In the meantime, the energy recovery capacitor $C_C$ is already charged with a voltage ($V_S/2$) that is half the sustain discharge voltage $V_S$, lest an inrush current be generated at the start of a sustain discharge.

At t0, while the terminal voltage $V_P$ of the panel is maintained at zero, the mode 1 begins to turn the switch $S_a$ ON and the switches $S_b$, $S_c$ and $S_d$ OFF.

In the operational interval (t0 to t1) of mode 1, an LC resonance path is formed in sequence of energy recovery capacitor $C_C$, switch $S_a$, diode $D_1$, inductor $L_C$, and plasma panel capacitor $C_P$. Accordingly, the current $I_L$ flowing to the inductor $L_C$ forms a half waveform because of LC resonance, and the output voltage $V_P$ of the panel gradually increases to the sustain discharge voltage $V_S$. The moment that the output voltage $V_P$ of the panel reaches the sustain discharge voltage $V_S$, almost no current flows to the inductor $L_C$.

The mode 2 begins at the end of the mode 1, to turn the switches $S_a$ and $S_c$ ON and the switches $S_b$ and $S_d$ OFF. In the operational interval (t1 to t2) of mode 2, the sustain discharge voltage $V_S$ is applied to the panel capacitor $C_P$ via the switch $S_c$ to maintain the output voltage $V_P$ of the panel.

At t1, zero-voltage switching occurs because the terminal voltage of the switch $S_c$ is ideally zero.

Once the mode 2 ends, the mode 3 begins to turn the switch $S_b$ ON and the switches $S_a$, $S_c$ and $S_d$ OFF.

In the operational interval (t2 to t3) of mode 3, an LC resonance path is formed in reverse path of the LC resonance path in mode 1, i.e., a current path including plasma panel capacitor $C_P$, inductor $L_C$, diode $D_2$, switch $S_b$, and energy recovery capacitor $C_C$ in sequence. Accordingly, as shown in FIG. 4, the current $I_L$ flows to the inductor $L_C$ and the output voltage $V_P$ of the panel falls, so that the current $I_L$ of the inductor $L_C$ and the output voltage $V_P$ of the panel reach zero at t3.

In the operational interval of mode 4, the switches $S_b$ and $S_d$ are turned ON and the switches $S_a$ and $S_c$ are OFF to maintain the output voltage $V_P$ of the panel at zero. Once the switch $S_a$ is ON in this state, the cycle returns to mode 1.

Such a conventional energy recovery circuit, however, causes a problem because it is impossible to perform zero-voltage switching of the switches constituting the circuit due to the parasitic components of the actual circuit (e.g., the parasitic resistance of the inductor, the parasitic resistance of the capacitor and the panel, or resistance of the switches) with a consequence of a great switching loss while the switch is on. In other words, the magnetic energy stored in the inductor $L_C$ is ideally zero in the conventional energy recovery circuit when the voltage at one terminal of the panel capacitor is increased by the sustain discharge voltage $V_S$. Thus, there is no source to raise the voltage at the terminal of the panel capacitor to $V_S$, if the voltage at the one terminal of the panel capacitor does not reach $V_S$ due to the parasitic components of the actual circuit. Accordingly, the actual switch $S_C$ is not capable of zero-voltage switching to increase a switching loss when it is turned on.

Also, the energy recovery capacitor $C_C$ of the conventional energy recovery circuit has to be charged with $V_S/2$ after starting discharge. Otherwise, a great inrush current is generated at the start of a sustain discharge pulse, which may require a protective circuit to reduce the inrush current.

Furthermore, a long period of rising/falling time of the panel voltage in the conventional energy recovery circuit may cause a discharge of the panel during the energy recovery interval (i.e., the rising/falling interval of the panel voltage). This may drop the panel voltage to cause a hard switching of the sustain switch $S_C$ and hence a great switching loss when the switch is turned on.

SUMMARY OF THE INVENTION

It is an object of the present invention to provide an apparatus and a method for driving a plasma display panel (PDP) that allows zero-voltage switching despite the parasitic components of the actual circuit.

It is another object of the present invention to provide an apparatus and a method for driving a PDP that reduces an inrush current at the start of a sustain discharge.

It is further another object of the present invention to provide an apparatus and a method for driving a PDP that reduces the rising/falling time of a panel voltage to allow a discharge in the sustain interval.

In one aspect of the present invention, an apparatus for driving a plasma display panel, in which pairs of scan electrodes and pairs of sustain electrodes are alternately disposed and a panel capacitor is formed between the scan electrode and the sustain electrode, comprises a sustain discharge unit comprising first and second switches serially connected between first and second voltages and having a contact connected to one terminal of the panel capacitor, and third and fourth switches serially connected between the first and second voltages and having a contact connected to another terminal of the panel capacitor, the sustain discharge unit maintaining either terminal voltage of the panel capacitor at the first or second voltage; a first charge/discharge unit comprising first and second capacitors serially connected between the first and second voltages, fifth and sixth switches each connected in parallel to a contact between the first and second capacitors, and a first inductor connected to a contact between the fifth and sixth switches and to the one terminal of the panel capacitor, the first charge/discharge unit charging the one terminal of the panel capacitor to the first voltage or discharging it to the second voltage; and a second charge/discharge unit comprising third and fourth capacitors serially connected between the first and second voltages, seventh and eighth switches each connected in parallel to a contact between the third and fourth capacitors, and a second inductor connected to a contact between the seventh and eighth switches and to the other terminal of the panel capacitor, the second charge/discharge unit charging the other terminal of the panel capacitor to the first voltage or discharging it to the second voltage.

In another aspect of the present invention, an apparatus for driving a plasma display panel, in which pairs of scan electrodes and pairs of sustain electrodes are alternately disposed and a panel capacitor is formed between the scan electrode and the sustain electrode, comprises: a sustain discharge unit comprising first and second switches serially connected between first and second voltages and having a contact connected to the one terminal of the panel capacitor, and third and fourth switches serially connected between the first and second voltages and having a contact connected to the other terminal of the panel capacitor, the sustain discharge unit maintaining either terminal voltage of the panel capacitor at the first or second voltage; a first charge/discharge unit comprising a first capacitor and a first variable voltage serially connected between the first and second voltages, fifth and sixth switches each connected in parallel to a contact between the first capacitor and the first variable voltage, and a first inductor connected to a contact between the fifth and sixth switches and to one terminal of the panel capacitor, the first charge/discharge unit charging the one terminal of the panel capacitor to the first voltage or discharging it to the second voltage; and a second charge/discharge unit comprising a second capacitor and a second variable voltage serially connected between the first and second voltages, seventh and eighth switches each connected in parallel to a contact between the second capacitor and the second variable voltage, and a second inductor connected to a contact between the seventh and eighth switches and to the other terminal of the panel capacitor, the second charge/discharge unit charging another terminal of the panel capacitor to the first voltage or discharging it to the second voltage.

In still another aspect of the present invention, an apparatus for driving a plasma display panel, in which pairs of scan electrodes and pairs of sustain electrodes are alternately disposed and a panel capacitor is formed between the scan electrode and the sustain electrode, comprises: a sustain discharge unit comprising first and second switches serially connected between first and second voltages and having a contact connected to one terminal of the panel capacitor, and third and fourth switches serially connected between the first and second voltages and having a contact connected to an other terminal of the panel capacitor, the sustain discharge unit maintaining either terminal voltage of the panel capacitor at the first or second voltage; and a charge/discharge unit comprising first and second inductors electrically connected to the one terminal and the other terminal of the panel capacitor, respectively, the charge/discharge unit boosting a current to store an energy in the first and second inductors while either terminal voltage of the panel capacitor is maintained at a sustain discharge voltage, the charge/discharge unit inverting the polarity of either terminal voltage of the panel capacitor using the energy stored in the first and second inductors.

In further another aspect of the present invention, a plasma display panel comprises: a panel comprising a plurality of address electrodes, a plurality of pairs of scan electrodes and pairs of sustain electrodes alternately arranged, and a panel capacitor formed between the scan electrode and the sustain electrode; a controller for receiving an external image signal, and generating an address drive control signal and a sustain discharge signal; an address driver for receiving the address drive control signal from the controller, and applying to the address electrodes a display data signal for selection of discharge cells to be displayed; and a scan/sustain driver for receiving the sustain discharge signal from the controller, and applying a sustain discharge voltage alternately to the scan electrodes and the sustain electrodes to perform a sustain discharge on the selected discharge cells, wherein the scan/sustain driver comprises: a sustain discharge unit comprising first and second switches serially connected between first and second voltages and having a contact connected to the one terminal of the panel capacitor, and third and fourth switches serially connected between the first and second voltages and having a contact connected to the other terminal of the panel capacitor, the sustain discharge unit maintaining either terminal voltage of the panel capacitor at the first or second voltage; and a charge/discharge unit comprising first and second inductors electrically connected to the one terminal and the other terminal of the panel capacitor, respectively, the charge/discharge unit boosting a current to a predetermined level for a later sustain discharge to store an energy in the first and second inductors while either terminal voltage of the panel capacitor is maintained at the sustain discharge voltage, the charge/discharge unit inverting the polarity of either terminal voltage of the panel capacitor using the energy stored in the first and second inductors.

In still further another aspect of the present invention, a method for driving a plasma display panel, in which pairs of scan electrodes and pairs of sustain electrodes are alternately disposed and a panel capacitor is formed between the scan electrode and the sustain electrode, comprises: (a) boosting a current flowing to first and second inductors electrically connected to one terminal and another terminal of the panel capacitor, respectively, to store an energy in the first and second inductors, while either terminal voltage of the panel capacitor is maintained at a sustain discharge voltage having a first polarity; (b) inverting the polarity of either terminal voltage of the panel capacitor using the energy stored in the first and second inductors; (c) recovering the energy stored in the first and second inductors while either terminal voltage of the panel capacitor is changed to a sustain discharge voltage having a second polarity opposite to the first polarity; and (d) maintaining either terminal voltage of the panel capacitor at the sustain discharge voltage having the second polarity.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

In the following detailed description, only the preferred embodiment of the invention has been shown and described, simply by illustrating the best mode contemplated by the inventor of carrying out the invention. As will be realized, the invention is capable of modification in various obvious respects, all without departing from the invention. Accordingly, the drawings and description are to be regarded as illustrative in nature, and not restrictive.

Figure 5:
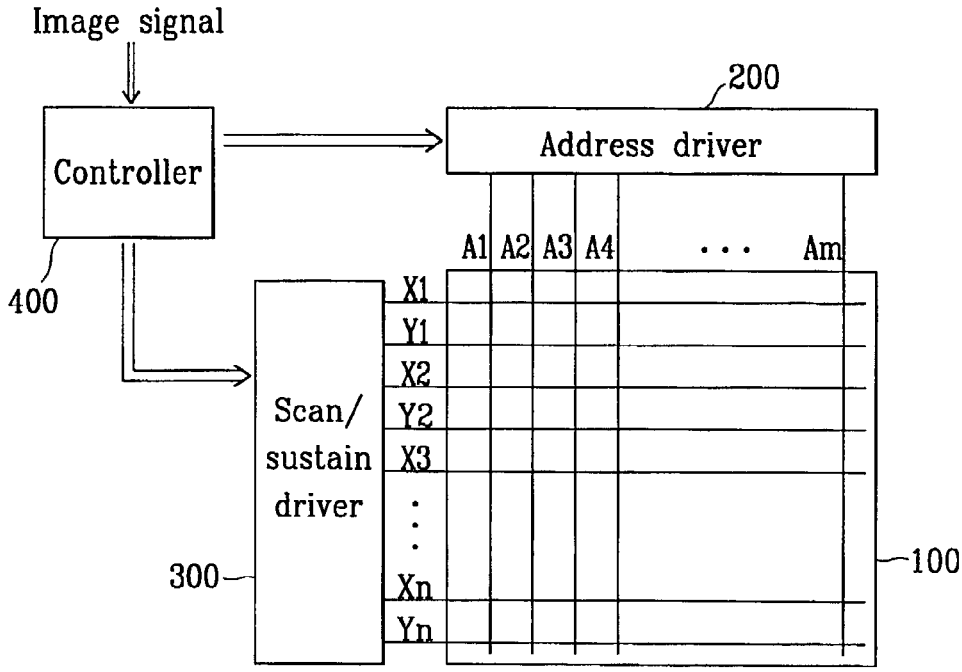
FIG. 5 illustrates a PDP in accordance with an embodiment of the present invention.

FIG. 5 illustrates a plasma display panel (PDP) in accordance with an embodiment of the present invention.

Referring to FIG. 5, the PDP according to the embodiment of the present invention comprises a plasma panel 100, an address driver 200, a scan/sustain driver 300, and a controller 400.

The plasma panel 100 comprises a plurality of address electrodes $A_1$ to $A_m$ arranged in columns and a plurality of scan electrodes $Y_1$ to $Y_n$ and sustain electrodes $X_1$ to $X_n$ alternately arranged in rows.

The address driver 200 receives an address drive control signal from the controller 400 and applies to the individual address electrodes a display data signal to select discharge cells for display.

The scan/sustain driver 300 receives a sustain discharge signal from the controller 400 and applies a sustain pulse voltage alternately to the scan electrodes and the sustain electrodes for a sustain discharge on the selected discharge cells.

The controller 400 receives an external image signal, generates the address drive control signal and the sustain discharge signal, and applies them to the address driver 200 and the scan/sustain driver 300, respectively.

Figure 6:
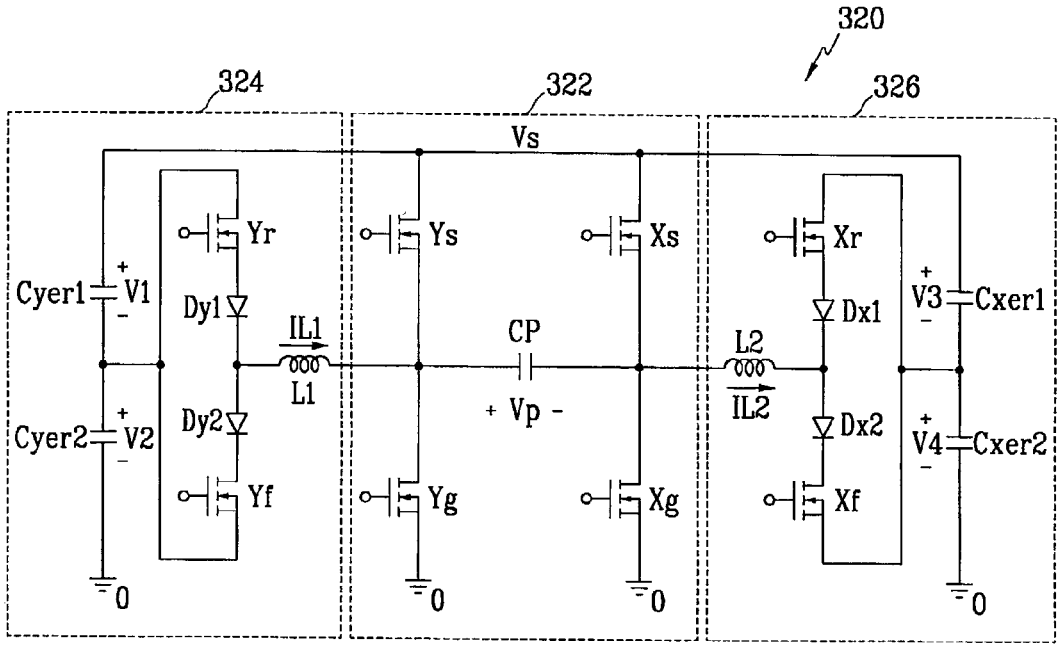
FIG. 6 illustrates an energy recovery circuit in accordance with an embodiment of the present invention.

The scan/sustain driver 300 according to the embodiment of the present invention includes an energy recovery circuit for recovering a reactive power and reusing it. FIG. 6 illustrates an energy recovery circuit 320 in accordance with a first embodiment of the present invention.

As illustrated in FIG. 6, the energy recovery circuit 320 according to the embodiment of the present invention comprises a sustain discharge unit 322, a Y electrode charge/discharge unit 324, and an X electrode charge/discharge unit 326.

The sustain discharge unit 322 comprises four sustain switches $Y_s$, $Y_g$, $X_s$ and $X_g$, each of which is composed of a MOSFET that has a body diode connected to a sustain discharge voltage $V_S$ or a ground voltage. The switching operations of these four switches allow the terminal voltages $V_y$ and $V_x$ of panel capacitor $C_P$ to be maintained at the sustain discharge voltage $V_S$ or the ground voltage.

The Y electrode charge/discharge unit 324 comprises energy recovery capacitors $C_{yer1}$ and $C_{yer2}$ serially connected between the sustain discharge voltage $V_S$ and the ground voltage; energy recovery switches $Y_r$ and $Y_f$ connected in parallel to a contact between the capacitors $C_{yer1}$ and $C_{yer2}$ in order to raise or drop the terminal voltage $V_P$ of the panel capacitor $C_P$; and an inductor $L_1$ formed between the contact between the energy recovery switches $Y_r$ and $Y_f$ and the panel capacitor $C_P$. The Y electrode charge/discharge unit 324 may further comprise diodes $D_{y1}$ and $D_{y2}$ connected to the switches $Y_r$ and $Y_f$, respectively, for determining a path for current supply to the panel capacitor $C_P$ and a path for current recovery from the panel capacitor $C_P$. The Y electrode charge/discharge unit 324 charges the Y electrodes of the panel capacitor to the sustain discharge voltage $V_S$ or discharges such voltage to the ground voltage.

The X electrode charge/discharge unit 326 comprises energy recovery capacitors $C_{xer1}$ and $C_{xer2}$ serially connected between the sustain discharge voltage $V_S$ and the ground voltage; energy recovery switches $X_r$ and $X_f$ connected in parallel to a contact between the capacitors $C_{xer1}$ and $C_{xer2}$ in order to raise or drop the terminal voltage $V_P$ of the panel capacitor $C_P$; and an inductor $L_2$ formed between the contact between the energy recovery switches $X_r$ and $X_f$ and the panel capacitor $C_P$. The X electrode charge/discharge unit 326 may further comprise diodes $D_{x1}$ and $D_{x2}$ connected to the switches $X_r$ and $X_f$, respectively, for determining a path for current supply to the panel capacitor $C_P$ and a path for current recovery from the panel capacitor $C_P$. The X electrode charge/discharge unit 326 charges the X electrodes of the panel capacitor to the sustain discharge voltage $V_S$ or discharges such voltage to the ground voltage.

Now, a description will be given to a method for driving the PDP in accordance with the first embodiment of the present invention with reference to FIGS. 7A, 7B, 7C, 7D, 7E, 7F, 7G, 7H and 8.

Figure 7A:
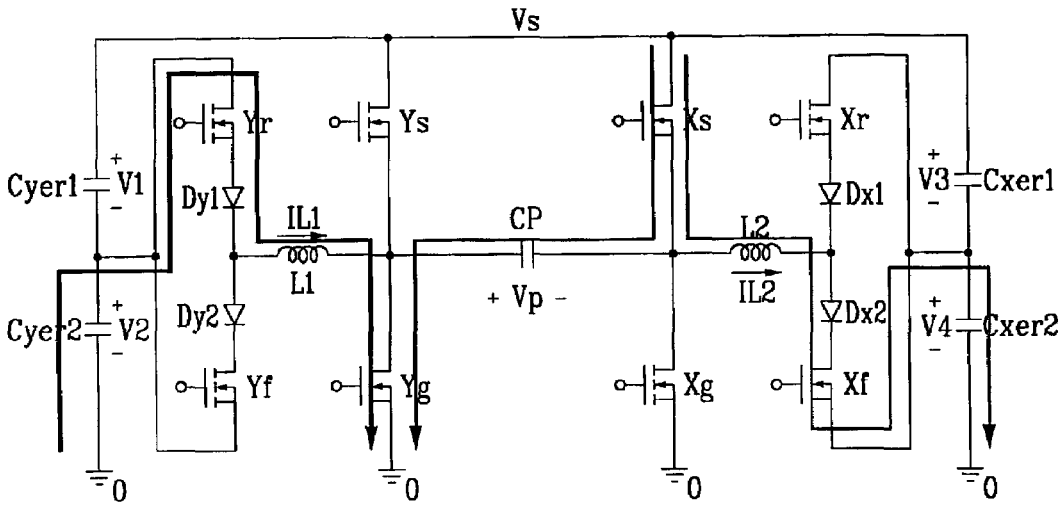
FIGS. 7A, 7B, 7C, 7D, 7E, 7F, 7G and 7H illustrate the individual operation modes of the energy recovery circuit shown in FIG. 6.
Figure 7B:
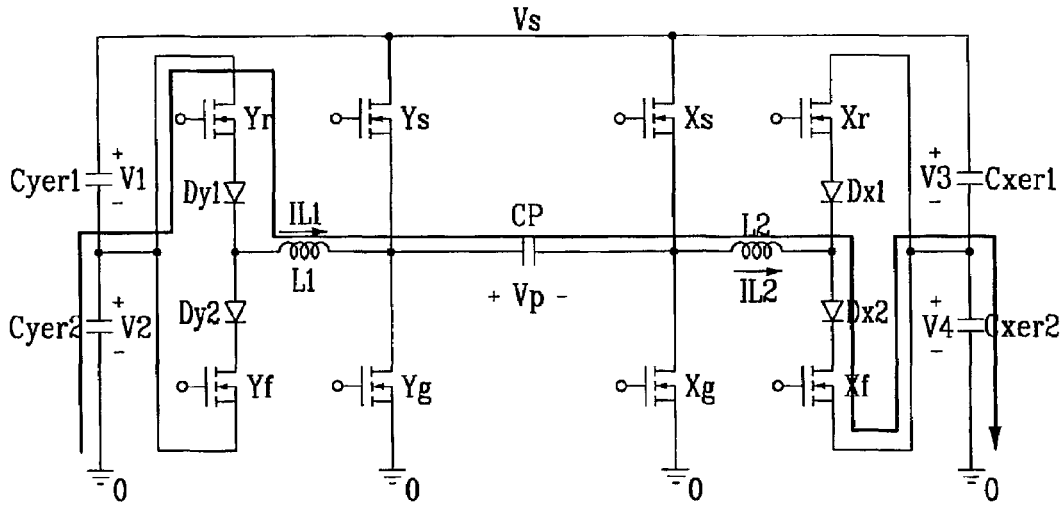
Figure 7C:
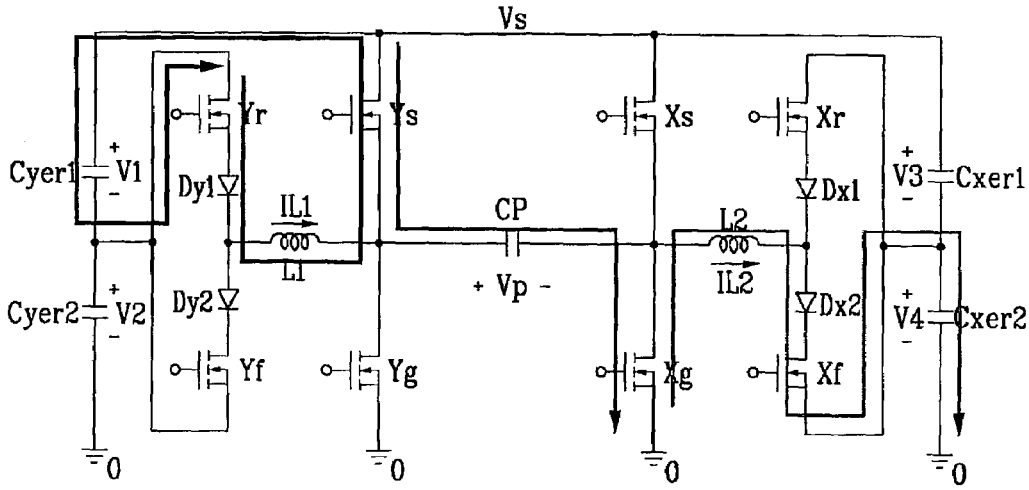
Figure 7D:
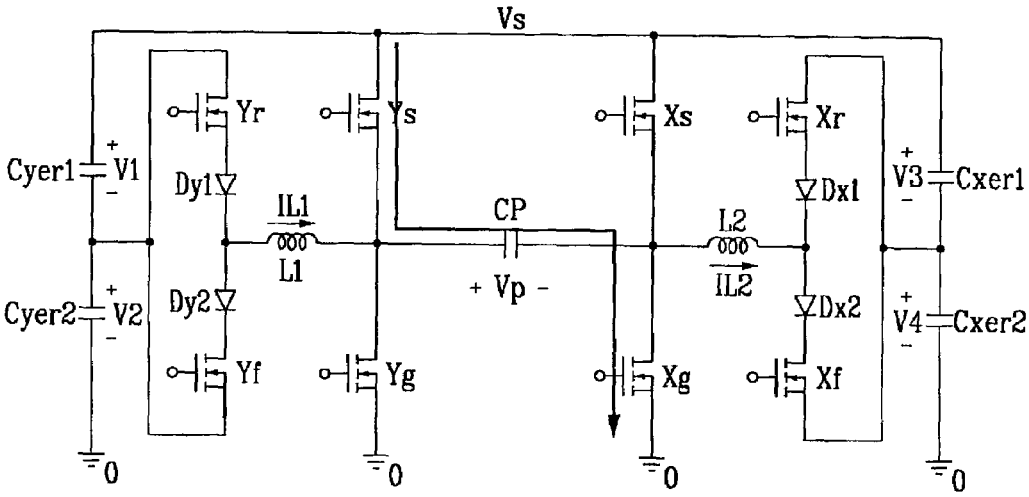
Figure 7E:
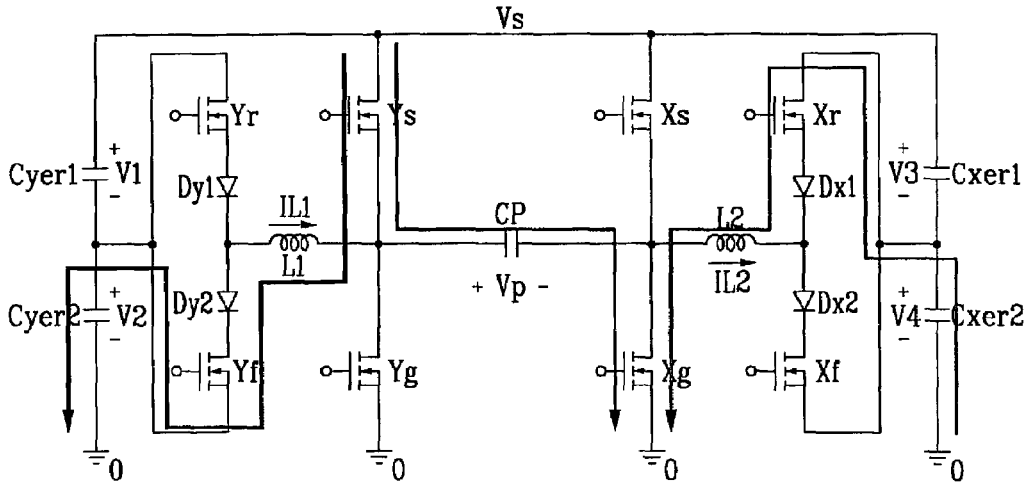
Figure 7F:
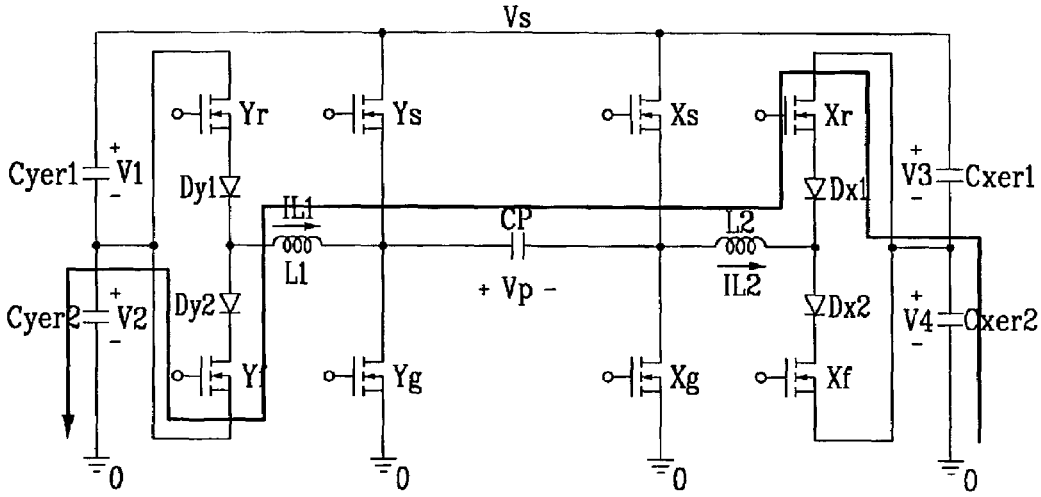
Figure 7G:
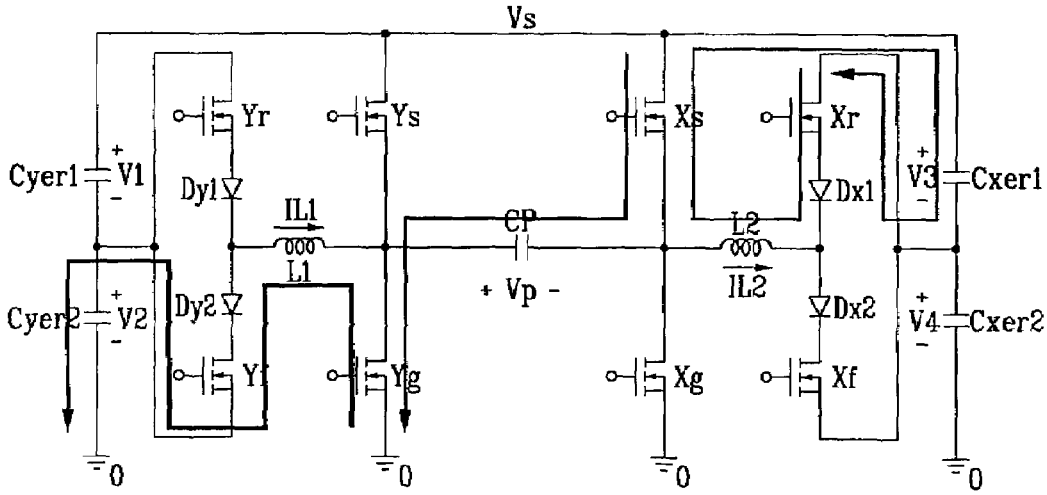
Figure 7H:
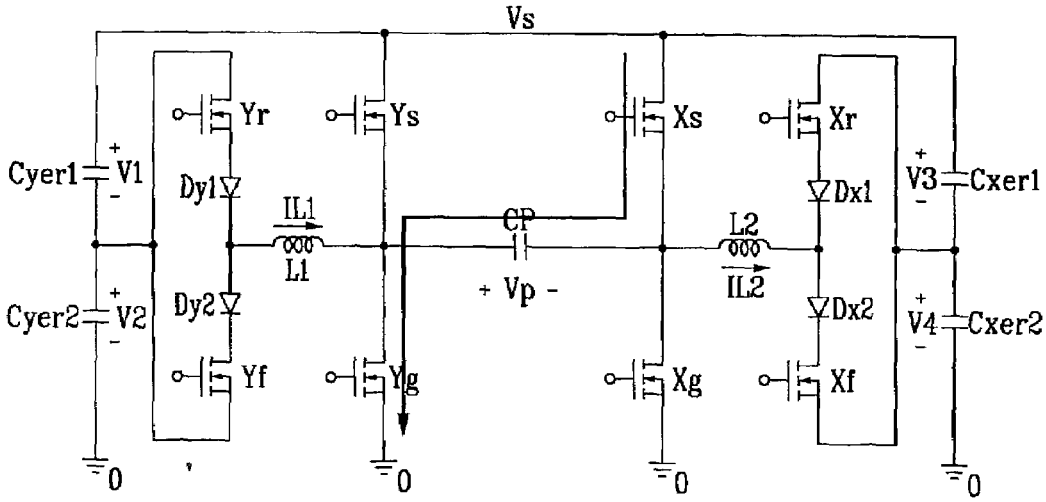
Figure 8:
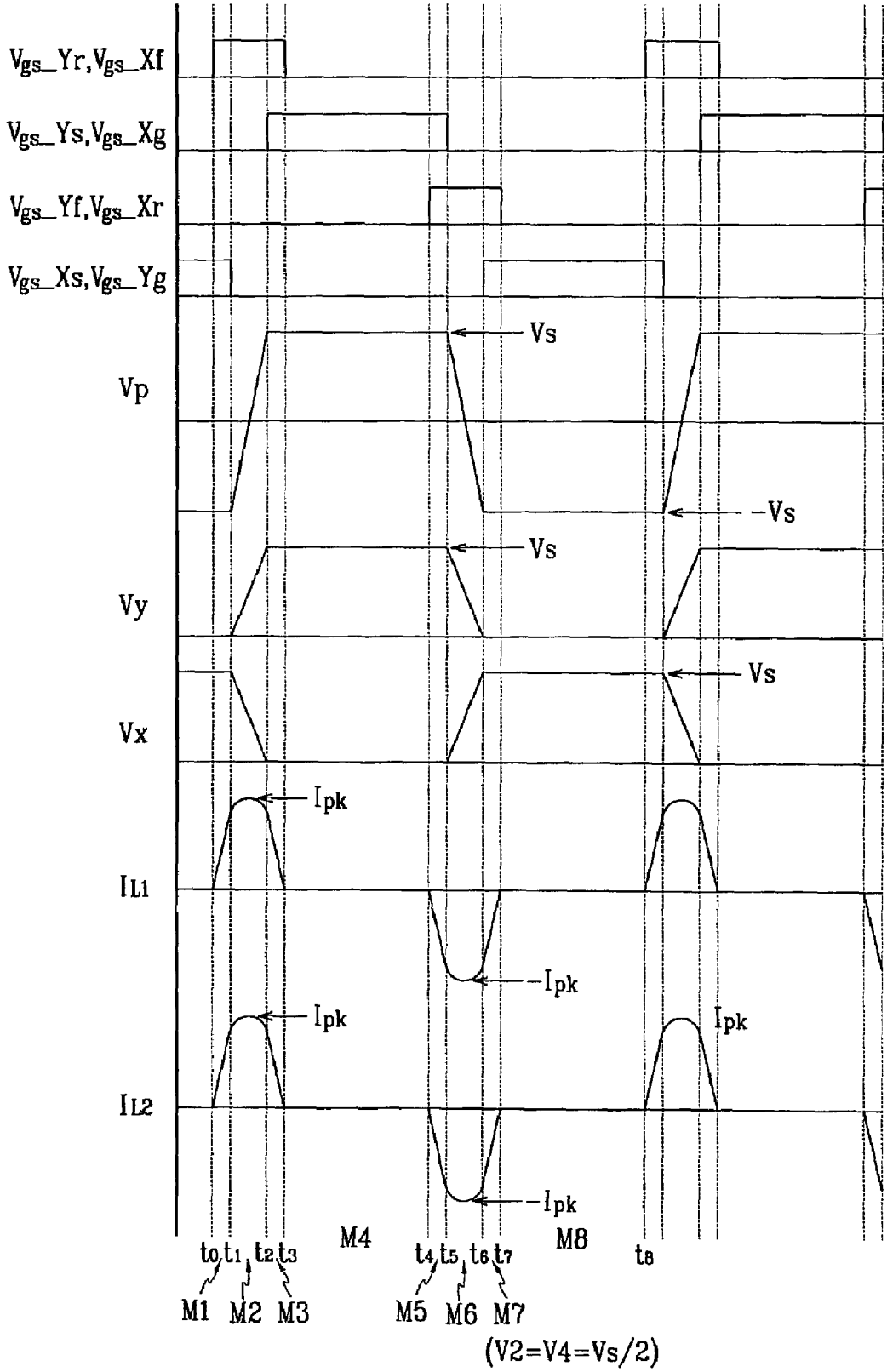
FIG. 8 illustrates a timing diagram in accordance with a first embodiment of the present invention.

FIGS. 7A through 7H illustrate the current paths formed in the respective operation modes according to the first embodiment of the present invention, and FIG. 8 is a timing diagram in accordance with the first embodiment of the present invention.

In the first embodiment of the present invention, it is assumed that before the start of mode 1, the switches $Y_g$ and $X_s$ are ON; $C_{yer1}$=V1, $C_{yer2}$=V2, $C_{xer1}$=V3 and $C_{xer2}$=V4; and $L_1$=$L_2$=L.

(1) Mode 1 (t0 through t1)

Referring to FIG. 7A, in the interval of mode 1, the switches $Y_r$ and $X_f$ are turned ON while the switches $Y_g$ and $X_s$ are ON. Once the switch $Y_r$ of the Y electrode charge/discharge unit 324 is turned ON, with the switches $Y_g$ and $X_s$ ON, there forms a current path including capacitor $C_{yer2}$, switch $Y_r$, inductor $L_1$ and switch $Y_g$ in sequence, as shown in FIG. 7A. On the other hand, when the switch $X_f$ of the X electrode charge/discharge unit 326 is turned ON, there forms a current path including switch $X_s$, inductor $L_2$, switch $X_f$ and capacitor $C_{xer2}$ in sequence. Accordingly, as shown in FIG. 8, currents $I_{L1}$ and $I_{L2}$ flowing to the inductors $L_1$ and $L_2$ in mode 1 linearly increase with slopes of V2/L and V3/L, respectively, to store the magnetic energy in the inductors $L_1$ and $L_2$.

(2) Mode 2 (t1 through t2)

Referring to FIG. 7B, in the interval of mode 2, the switches $X_s$ and $Y_g$ are turned OFF while the switches $Y_r$ and $X_f$ are ON. As a consequence, there forms a current path shown in FIG. 7B that includes capacitor $C_{yer2}$, switch $Y_r$, inductor $L_1$, panel capacitor $C_P$, inductor $L_2$, switch $X_f$ and capacitor $C_{xer2}$ in sequence. Accordingly, as shown in FIG. 8, a resonance current caused by the panel capacitance flows to the inductors $L_1$ and $L_2$ and the terminal voltage $V_P$ of the panel capacitor is inverted in polarity from $-V_S$ to $V_S$. That is, in the interval of mode 2, the voltage $V_y$ at the Y electrode of the panel capacitor $C_P$ rises from the ground voltage to the sustain discharge voltage $V_S$ and the voltage $V_x$ at the X electrode of the panel capacitor $C_P$ drops from the sustain discharge voltage $V_S$ to the ground voltage, so that the terminal voltage $V_P$ of the panel capacitor is inverted in polarity from —$V_S$ to $V_S$.

(3) Mode 3 (t2 through t3)

Referring to FIG. 7C, in the interval of mode 3, the switches $Y_s$ and $X_g$ are turned ON while the switches $Y_r$ and $X_f$ are ON.

At t=t2, once the voltage $V_y$ reaches the sustain discharge voltage $V_S$ and the voltage $V_x$ reaches the ground voltage, the body diodes of the switches $Y_s$ and $X_g$ are turned ON. As shown in FIG. 8, when the switches $Y_s$ and $X_g$ are ON at the voltage between their drain and source being zero. In other words, when they perform zero-voltage switching, there is no turn-on switching loss. According to the embodiment of the present invention, enough energy is ideally stored in the inductor $L_1$ even when the voltage at the Y electrode of the panel capacitor reaches the sustain discharge voltage $V_S$, so that the energy at the inductor $L_1$ allows the voltage at the Y electrode of the panel capacitor to increase to the sustain discharge voltage $V_S$. Hence, the switch $Y_s$ is capable of zero-voltage switching despite the parasitic components of the circuit.

In the mode 3, as shown in FIG. 8, the terminal voltage $V_P$ of the panel is maintained at $+V_S$. The current $I_{L1}$ flowing to the inductor $L_1$ of the Y electrode charge/discharge unit 324 is linearly decreased to zero with a slope of −V1/L through a current path that includes capacitor $C_{yer1}$, switch $Y_r$, inductor $L_1$, the body diode of switch $Y_s$ and power source $V_S$ in sequence. Namely, the energy stored in the inductor $L_1$ is recovered into the capacitor $C_{yer1}$ via the body diode of the switch $Y_s$. The current $I_{L2}$ flowing to the inductor $L_2$ of the X electrode charge/discharge unit 326 is also linearly decreased to zero with a slope of −V4/L through a current path that includes the body diode of switch $X_g$, inductor $L_2$, switch $X_f$ and capacitor $C_{xer2}$ in sequence. Namely, the energy stored in the inductor $L_2$ is recovered into the capacitor $C_{xer2}$ via the switch $X_f$.

Here, the negative sign of the currents $I_{L1}$ and $I_{L2}$ flowing to the inductors $L_1$ and $L_2$ implies that the currents flow in a direction opposite to the reference direction.

(4) Mode 4 (t3 through t4)

Referring to FIG. 7D, in the interval of mode 4, the switches $Y_r$ and $X_f$ are turned OFF while the switches $Y_s$ and $X_g$ are ON, and the terminal voltage $V_P$ of the panel is maintained at the sustain discharge voltage $+V_S$.

In mode 4, the voltage $V_y$ at the Y electrode of the panel capacitor is maintained at $V_S$, the voltage $V_x$ at the X electrode of the panel capacitor being maintained at the ground voltage. Hence, the terminal voltage $V_P$ of the panel capacitor is maintained at $+V_S$ to discharge the panel.

(5) Mode 5 (t4 through t5)

Referring to FIG. 7E, in the interval of mode 5, the switches $Y_f$ and $X_r$ are turned ON while the switches $Y_s$ and $X_g$ are ON. Once the switch $Y_f$ of the Y electrode charge/discharge unit 324 is turned ON, there forms a current path including switch $Y_s$, inductor $L_1$, switch $Y_f$ and capacitor $C_{yer2}$ in sequence. On the other hand, when the switch $X_r$ of the X electrode charge/discharge unit 326 is turned ON, there forms a current path shown in FIG. 7E that includes capacitor $C_{xer2}$, switch $X_r$, inductor $L_2$ and switch $X_g$ in sequence. Accordingly, as shown in FIG. 8, currents $I_{L1}$ and $I_{L2}$ flowing to the inductors $L_1$ and $L_2$ in mode 5 linearly decrease with slopes of $-V1/L$ and $-V4/L$, respectively, to store the magnetic energy in the inductors $L_1$ and $L_2$.

(6) Mode 6 (t5 through t6)

Referring to FIG. 7F, in the interval of mode 6, the switches $Y_s$ and $X_g$ are turned OFF while the switches $X_r$ and $Y_f$ are ON. As a consequence, there forms a current path shown in FIG. 7F that includes capacitor $C_{xer2}$, switch $X_r$, inductor $L_2$, panel capacitor $C_P$, inductor $L_1$, switch $Y_f$ and capacitor $C_{yer2}$ in sequence. Accordingly, as shown in FIG. 8, a resonance current caused by the panel capacitance flows to the inductors $L_1$ and $L_2$ and the terminal voltage $V_P$ of the panel capacitor is inverted in polarity from $V_S$ to $-V_S$. That is, in the interval of mode 6, the voltage $V_x$ at the X electrode of the panel capacitor $C_P$ rises from the ground voltage to the sustain discharge voltage $V_S$ and the voltage $V_y$ at the Y electrode of the panel capacitor $C_P$ drops from the sustain discharge voltage $V_S$ to the ground voltage, so that the terminal voltage $V_P$ of the panel capacitor is inverted in polarity from $V_S$ to $-V_S$.

(7) Mode 7 (t6 through t7)

Referring to FIG. 7G, in the interval of mode 7, the switches $X_s$ and $Y_g$ are turned ON while the switches $X_r$ and $Y_f$ are ON.

At t=t6, once the voltage $V_x$ reaches the sustain discharge voltage $V_S$ and the voltage $V_y$ reaches the ground voltage, the body diodes of the switches $X_s$ and $Y_g$ are turned ON. As shown in FIG. 8, when the switches $X_s$ and $Y_g$ are ON at the voltage between their drain and source being zero, i.e., when they perform zero-voltage switching, no turn-on switching loss occurs with them.

In the mode 7, as shown in FIG. 8, the terminal voltage $V_P$ of the panel is maintained at $-V_S$. The current $I_{L1}$ flowing to the inductor $L_1$ of the Y electrode charge/discharge unit 324 is linearly increased to zero with a slope of V2/L through a current path that includes the body diode of switch $Y_g$, inductor $L_1$, switch $Y_f$ and capacitor $C_{yer2}$ in sequence. Namely, the energy stored in the inductor $L_1$ is recovered into the capacitor $C_{yer2}$ via the switch $Y_f$. The current $I_{L2}$ flowing to the inductor $L_2$ of the X electrode charge/discharge unit 326 is also linearly increased to zero with a slope of V3/L through a current path that includes capacitor $C_{xer1}$, switch $X_r$, inductor $L_2$, the body diode of switch $X_s$ and power source $V_S$ in sequence. Namely, the energy stored in the inductor $L_2$ is recovered into the capacitor $C_{xer1}$ via the body diode of the switch $X_s$.

(8) Mode 8 (t7 through t8)

Referring to FIG. 7H, in the interval of mode 8, the switches $X_r$ and $Y_f$ are turned OFF while the switches $X_s$ and $Y_g$ are ON, and the terminal voltage $V_P$ of the panel is maintained at the sustain discharge voltage $-V_S$.

In mode 8, the voltage $V_x$ at the X electrode of the panel capacitor is maintained at $V_S$, the voltage $V_y$ at the Y electrode of the panel capacitor being maintained at the ground voltage. Hence, the terminal voltage $V_P$ of the panel capacitor is maintained at $-V_S$ to illuminate the panel.

According to the first embodiment of the present invention as described above, the currents of the inductors for energy recovery are boosted in modes 1 and 5, that is, before the polarity of the panel capacitor $C_P$ is inverted. The boosted currents (energy) are used to invert the polarity of the panel capacitor in modes 2 and 6. In such a way, terminal voltage of the panel capacitor is either raised to the sustain discharge voltage $V_S$ or dropped to the ground voltage irrespective of the energy recovery rate. Accordingly, in the first embodiment of the present invention, it is possible to perform zero-voltage switching by using the boosted currents of the inductors.

The energy recovery circuit according to the embodiment of the present invention as shown in FIG. 6 controls the intervals where the gate signals of the energy recovery switches $Y_r$, $Y_f$, $X_r$ and $X_f$ overlap those of the sustain switches $Y_s$, $Y_g$, $X_s$ and $X_g$ to regulate the voltage level of the energy recovery capacitors $C_{yer1}$, $C_{yer2}$, $C_{xer1}$ and $C_{xer2}$.

Figure 9:
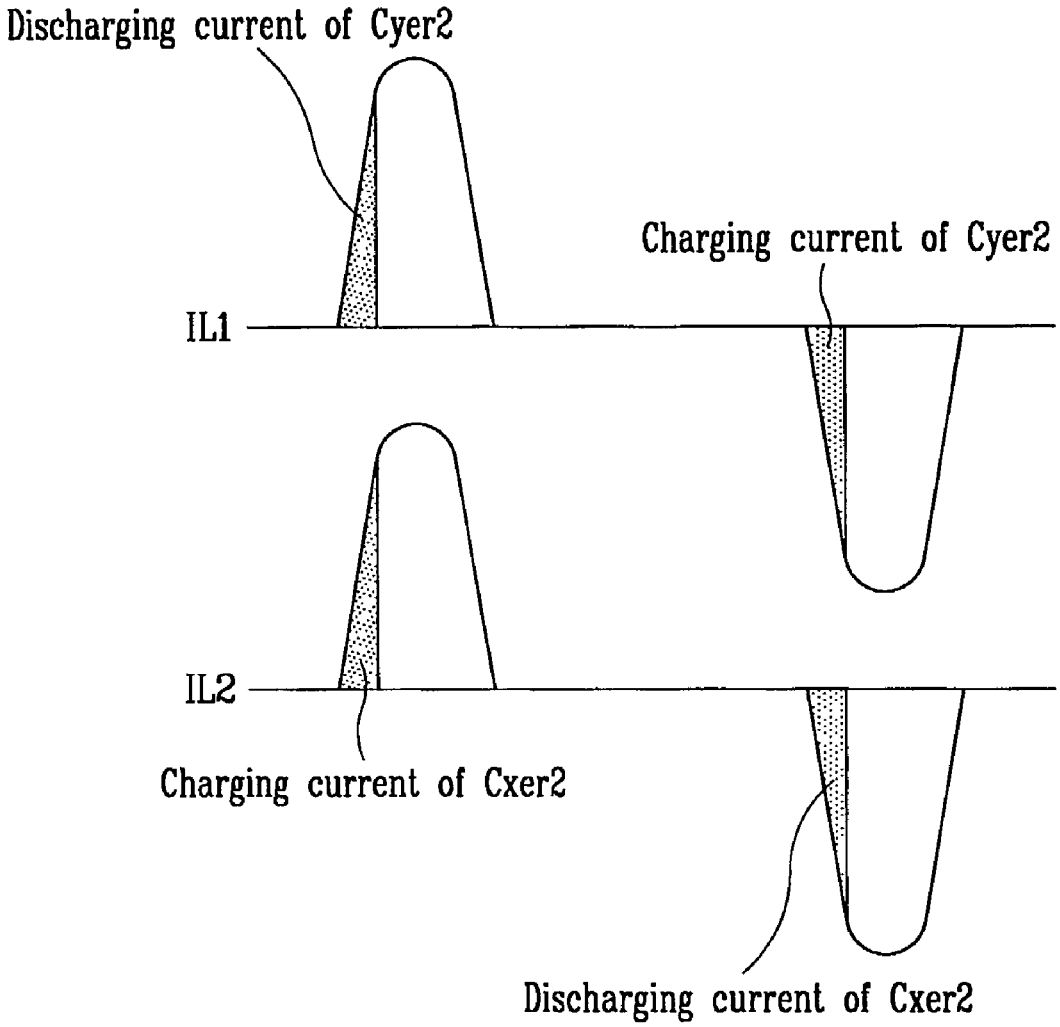
FIG. 9 illustrates the charging/discharging current of inductors in accordance with the first embodiment of the present invention.

That is, when the interval where the gate signals of the sustain switches $Y_s$ and $X_g$ overlap those of the energy recovery switches $Y_r$, $Y_f$, $X_r$ and $X_f$ is equal to the interval where the gate signals of the sustain switches $X_s$ and $Y_g$ overlap those of the energy recovery switches $Y_r$, $Y_f$, $X_r$ and $X_f$, as shown in FIG. 8 according to the first embodiment of the present invention, the charging/discharging current of the capacitor $C_{yer2}$ becomes equal to that of the capacitor $C_{xer2}$, as shown in FIG. 9. Thus, the terminal voltages V2 and V4 of the respective capacitors $C_{yer2}$ and $C_{xer2}$ are maintained at $V_S/2$. Accordingly, it satisfies $V1=V2=V3=V4=V_S/2$ in the first embodiment of the present invention.

Figure 10:
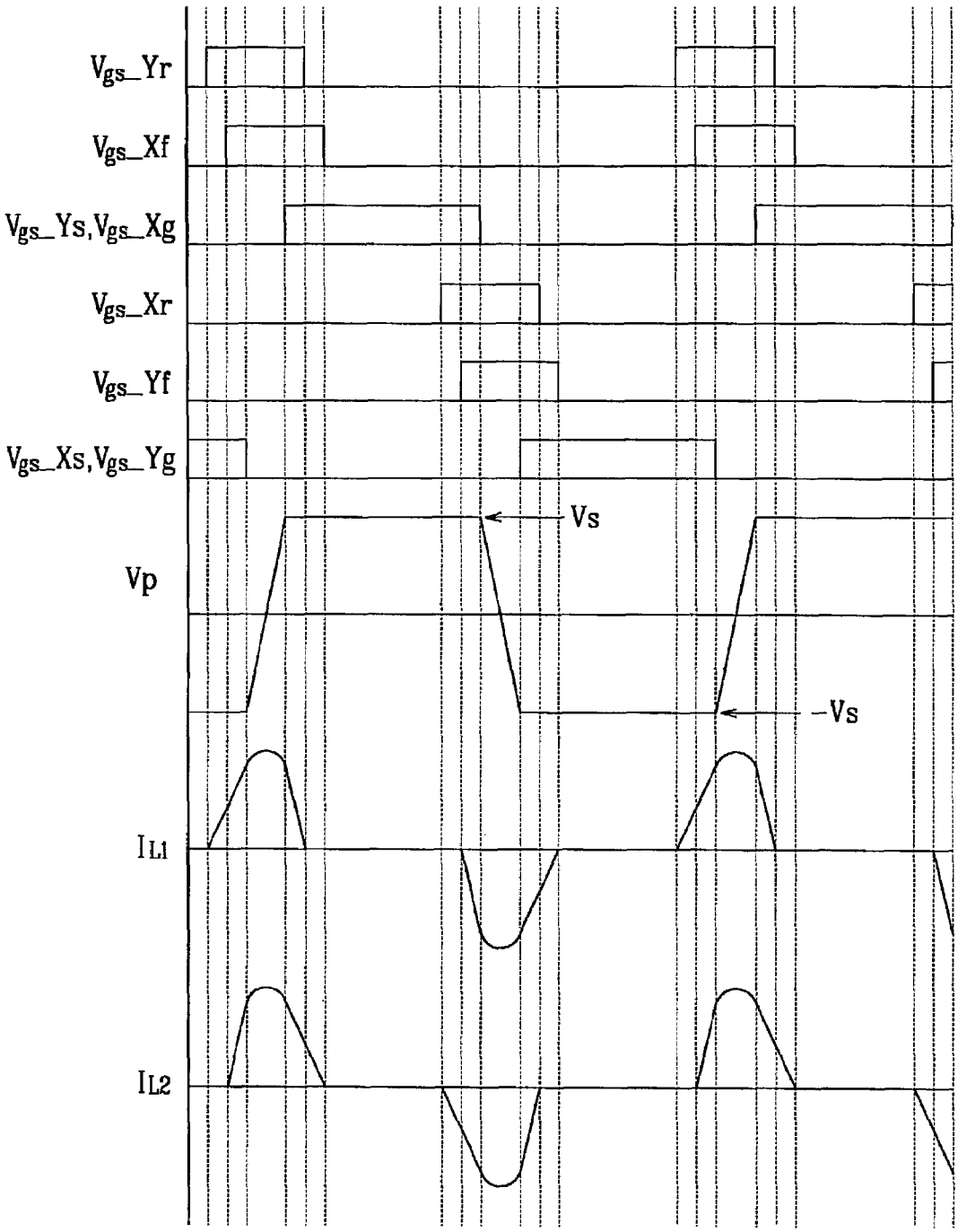
FIG. 10 illustrates a timing diagram in accordance with a second embodiment of the present invention.
Figure 11:
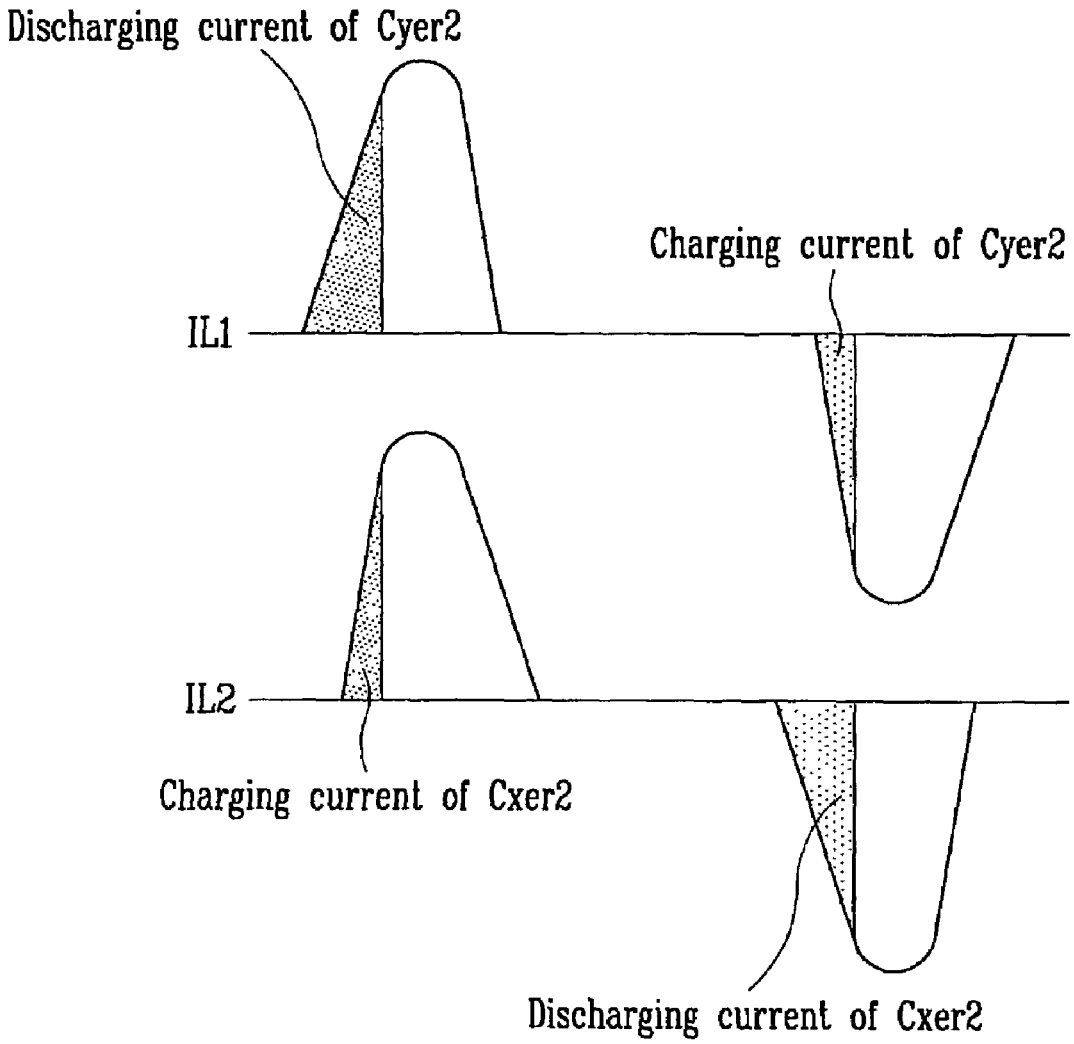
FIG. 11 illustrates the charging/discharging current of inductors in accordance with the second embodiment of the present invention.

When the interval where the gate signals of the energy recovery switches $Y_r$ and $X_r$ overlap those of the sustain switches $Y_s$, $Y_g$, $X_s$ and $X_g$ is longer than the interval where the gate signals of the energy recovery switches $Y_f$ and $X_f$ overlap those of the sustain switches $Y_s$, $Y_g$, $X_s$ and $X_g$, as shown in FIG. 10 according to a second embodiment of the present invention, the discharging current of the capacitors $C_{yer2}$ and $C_{xer2}$ becomes higher than their charging current, as shown in FIG. 11. Accordingly, the terminal voltages V2 and V4 of the respective capacitors $C_{yer2}$ and $C_{xer2}$ are below $V_S/2$.

Figure 12:
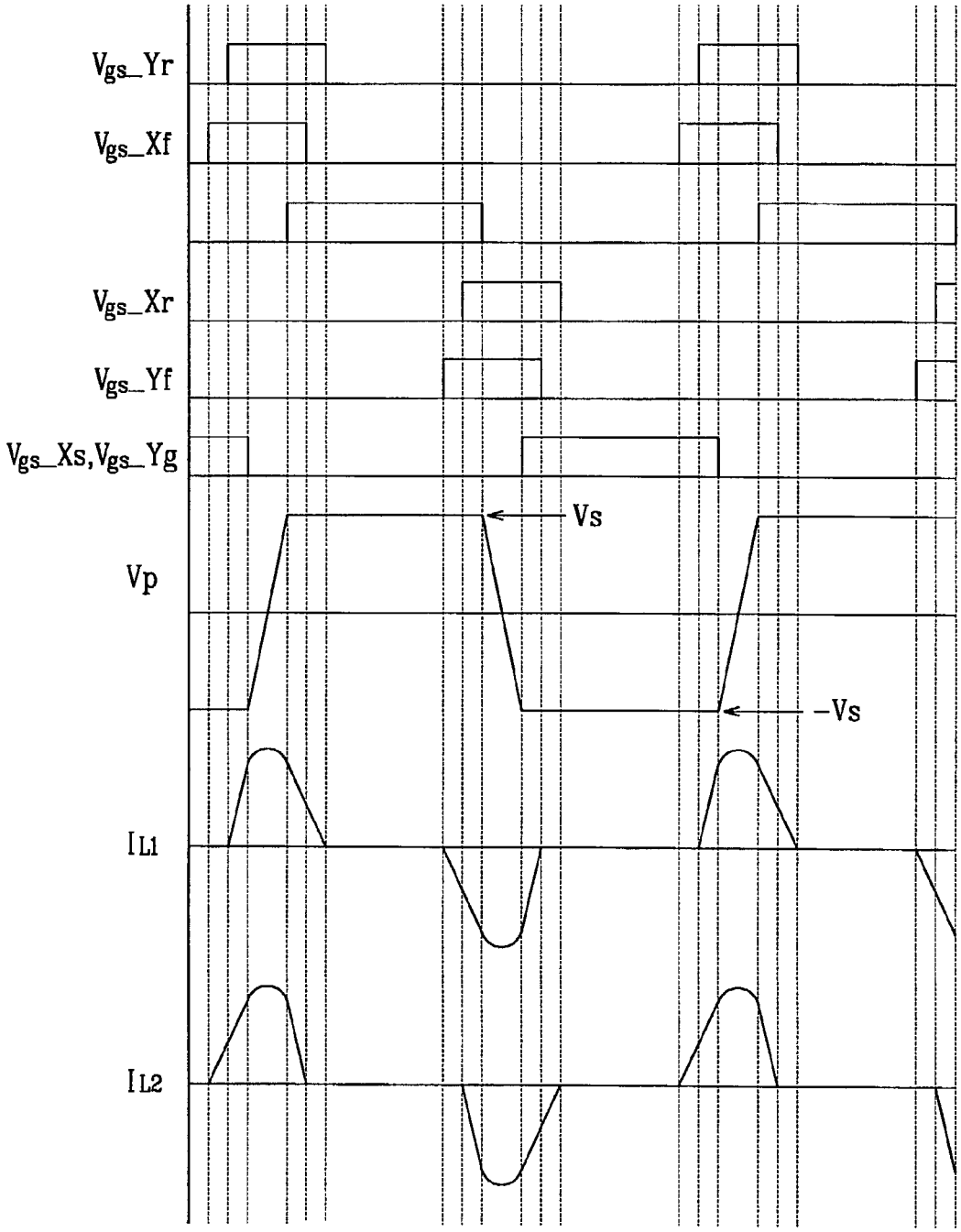
FIG. 12 illustrates an operational timing in accordance with a third embodiment of the present invention.
Figure 13:
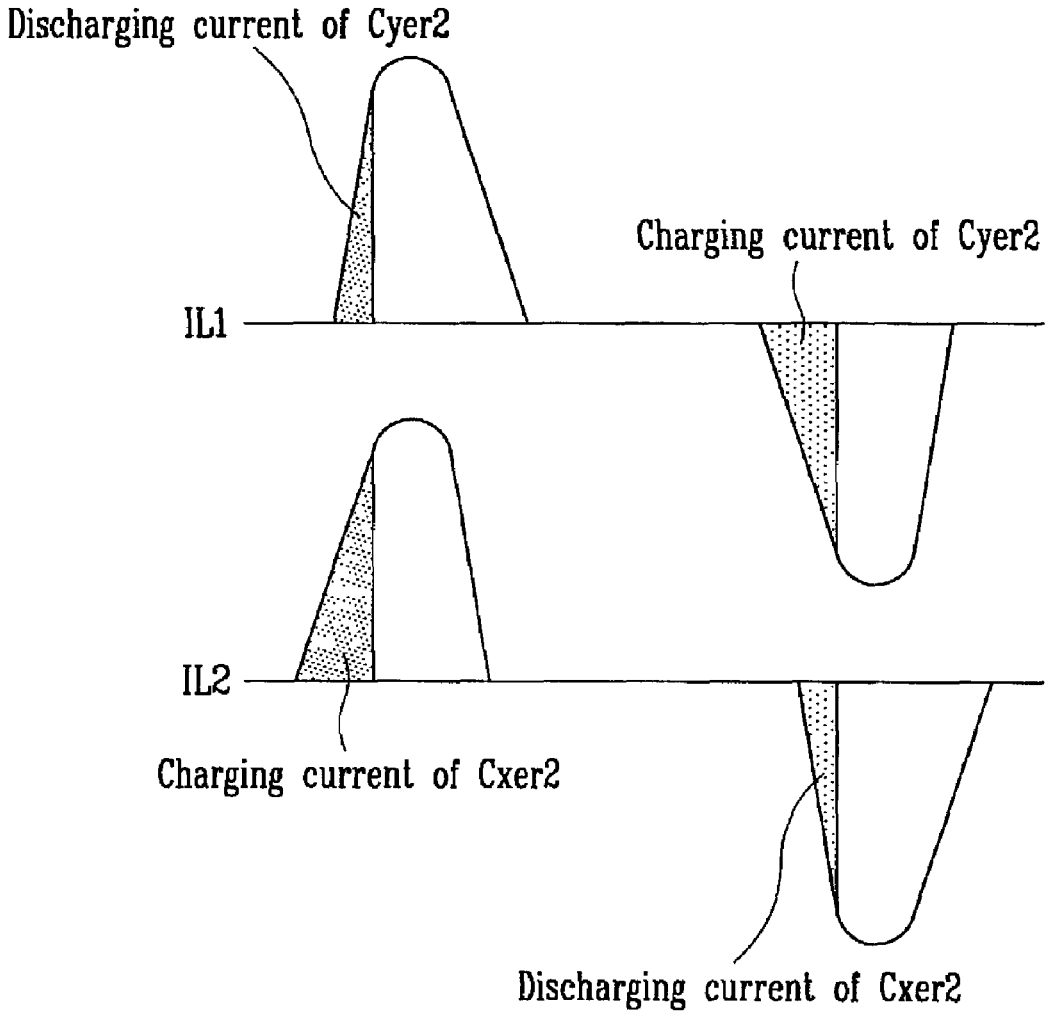
FIG. 13 illustrates the charging/discharging current of inductors in accordance with the third embodiment of the present invention.

To the contrary, when the interval where the gate signals of the energy recovery switches $Y_r$ and $X_r$ overlap those of the sustain switches $Y_s$, $Y_g$, $X_s$ and $X_g$ is shorter than the interval where the gate signals of the energy recovery switches $Y_f$ and $X_f$ overlap those of the sustain switches $Y_s$, $Y_g$, $X_s$ and $X_g$, as shown in FIG. 12 according to a third embodiment of the present invention, the discharging current of the capacitors $C_{yer2}$ and $C_{xer2}$ becomes lower than the charging current of them, as shown in FIG. 13. Accordingly, the terminal voltages V2 and V4 of the respective capacitors $C_{yer2}$ and $C_{xer2}$ are above $V_S/2$.

The driving timing diagrams shown in FIGS. 10 and 12 respectively according to the second embodiment and the third embodiment of the present invention use the same circuit as the energy recovery circuit shown in FIG. 6. However, the driving timing of the switches is different. The operation of the energy recovery circuit according to the second embodiment and the third embodiment of the present invention can be understood to those skilled in the art, with reference to FIGS. 6 and 8. Thus, further descriptions are omitted.

Figure 1:
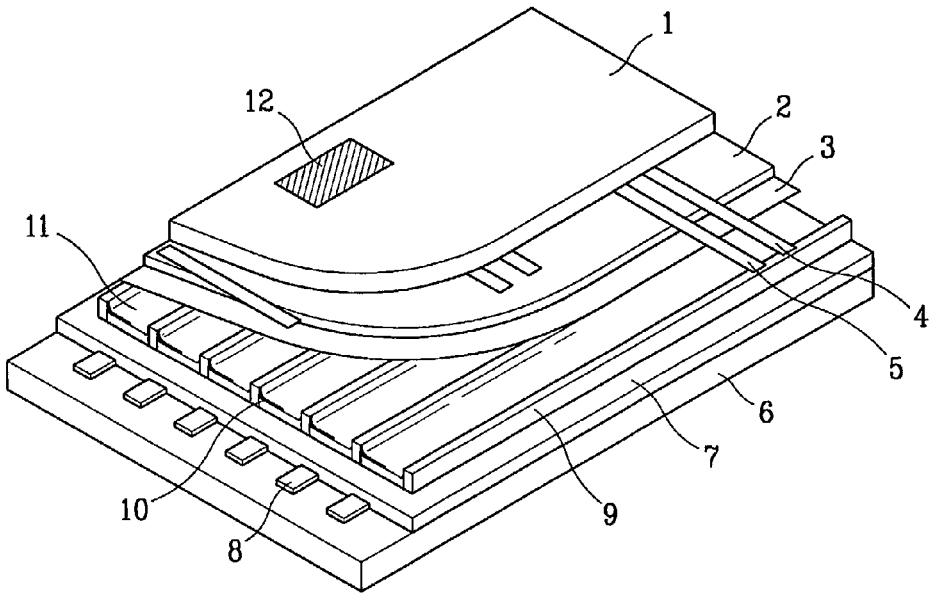
FIG. 1 is a partial perspective of an AC type PDP.
Figure 2:
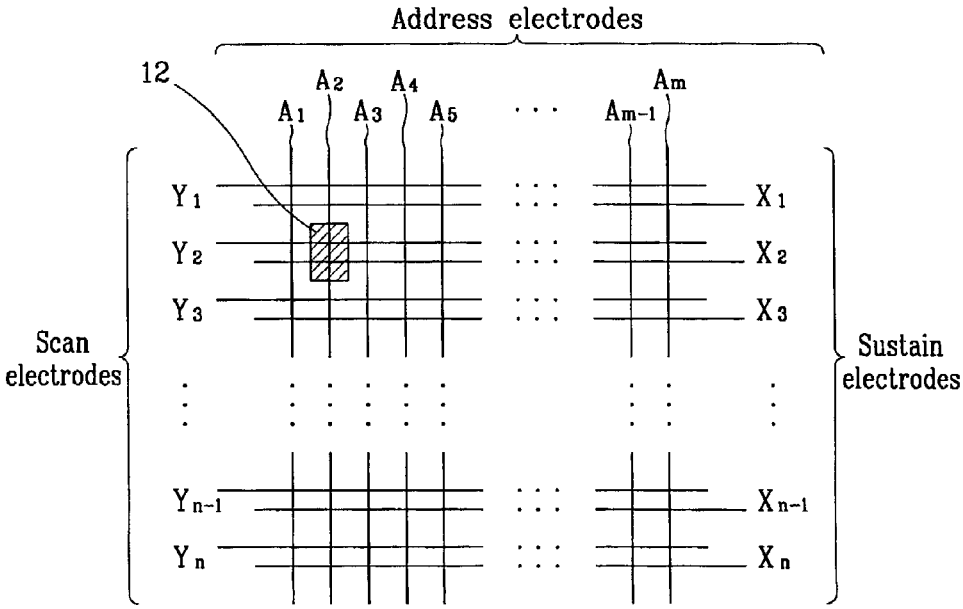
FIG. 2 illustrates an arrangement of electrodes in the PDP.
Figure 3:
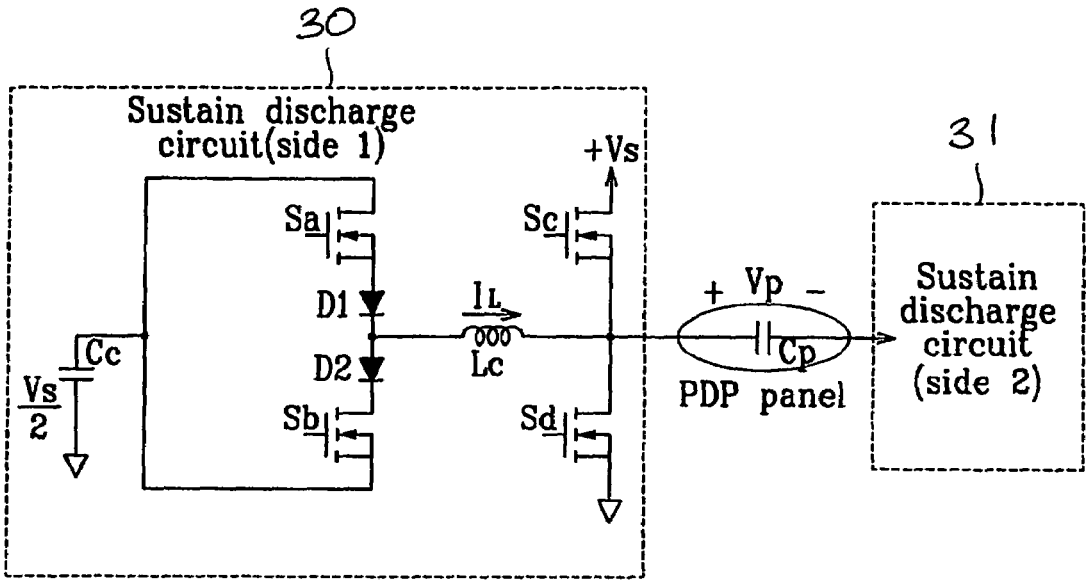
FIG. 3 (PRIOR ART)
FIGS. 3 and 4 illustrate conventional energy recovery circuit and its driving waveform, respectively.
Figure 4:
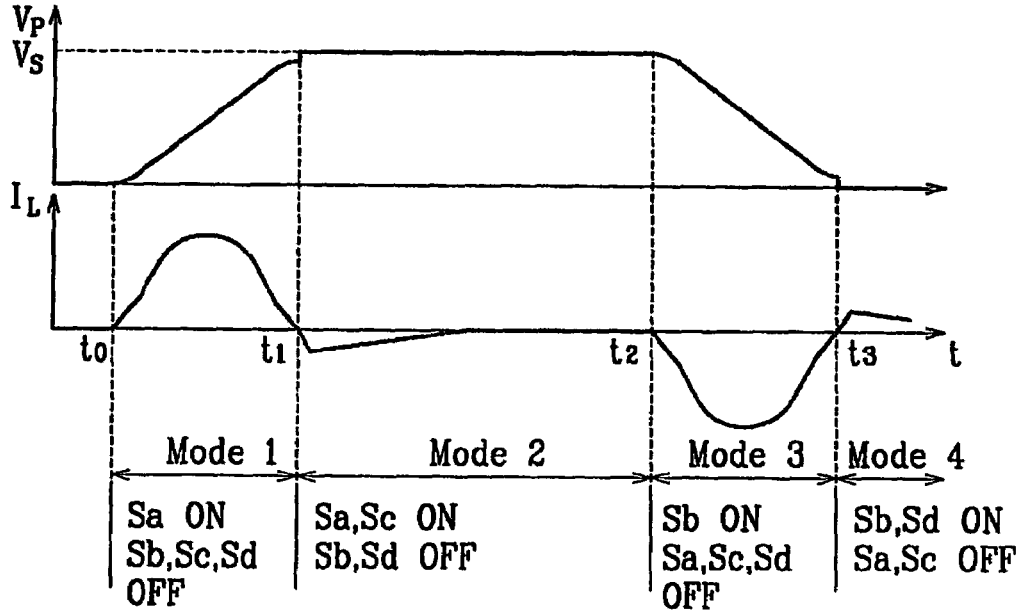
FIG. 4 (PRIOR ART)

Unlike the conventional energy recovery circuit shown in FIG. 3, the energy recovery circuit shown in FIG. 6 uses the voltages of the energy recovery capacitors only as a power source for boosting the current, and not to maintain the value of the voltage at $V_S/2$.

Although the energy recovery circuit shown in FIG. 6 regulates the voltage levels of the energy recovery capacitors $C_{yer1}$, $C_{yer2}$, $C_{xer1}$ and $C_{xer2}$ by controlling the intervals where the gate signals of the energy recovery switches $Y_r$, $Y_f$, $X_r$ and $X_f$ overlap those of the sustain switches $Y_s$, $Y_g$, $X_s$ and $X_g$, the voltage levels can also be regulated in the following manner.

Figure 14:
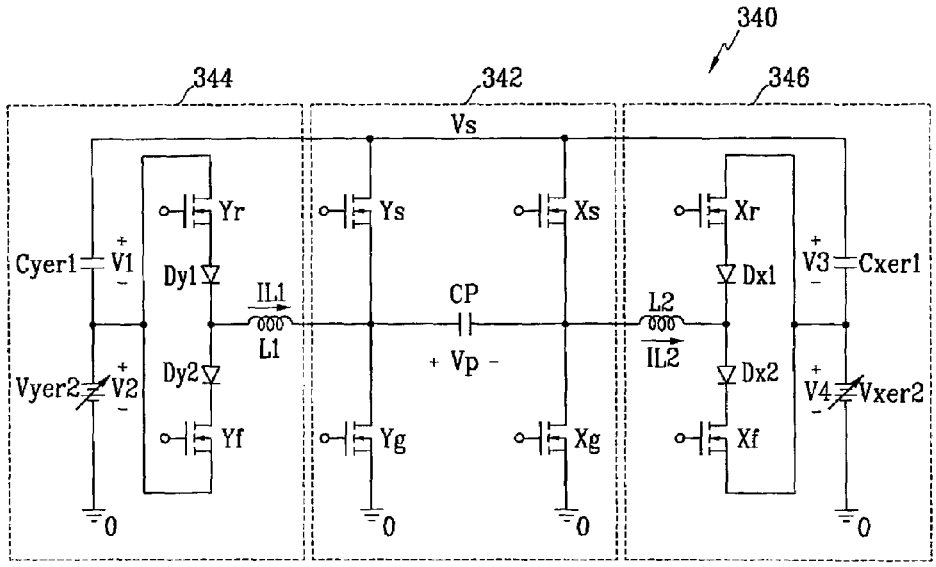
FIG. 14 illustrates an energy recovery circuit in accordance with a fourth embodiment of the present invention.

FIG. 14 illustrates an energy recovery circuit 340 according to a fourth embodiment of the present invention. Referring to FIG. 14, the energy recovery circuit 340 comprises a sustain discharge unit 342, a Y electrode charge/discharge unit 344, and an X electrode charge/discharge unit 346.

The sustain discharge unit 342, the Y electrode charge/discharge unit 344 and the X electrode charge/discharge unit 346 shown in FIG. 14 are quite similar in constituent components and operation to the sustain discharge unit 322, the Y electrode charge/discharge unit 324 and the X electrode charge/discharge unit 326 shown in FIG. 6. The difference is that variable voltages $V_{yer2}$ and $V_{xer2}$ are used instead of the capacitors $C_{yer2}$ and $C_{xer2}$.

Figure 15:
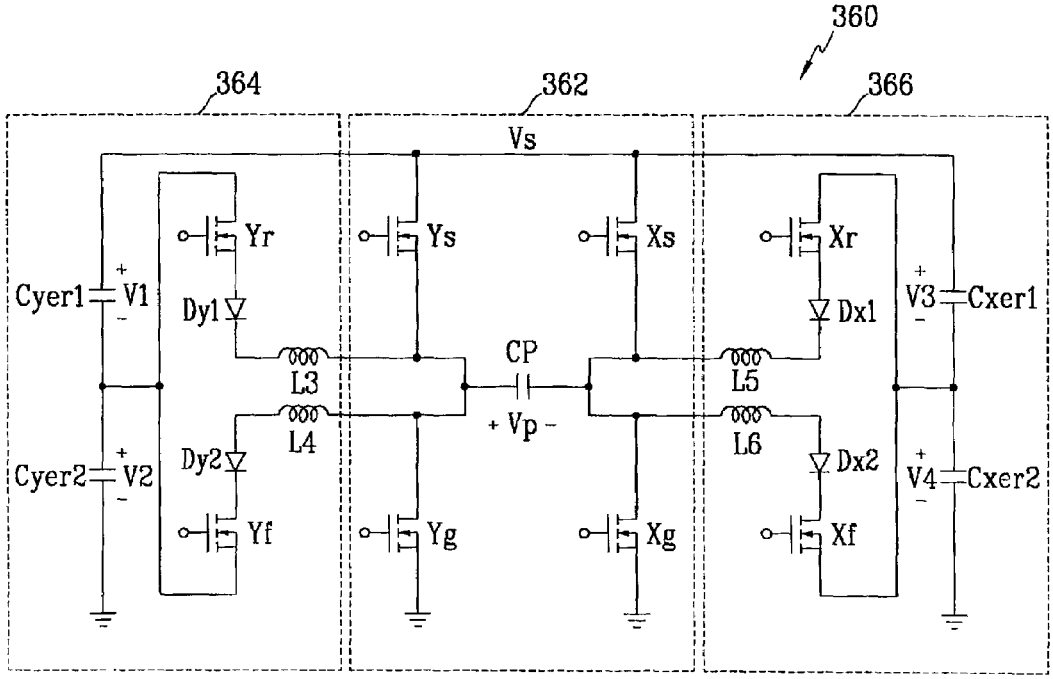
FIG. 15 illustrates an energy recovery circuit in accordance with a fifth embodiment of the present invention.
Figure 16A:
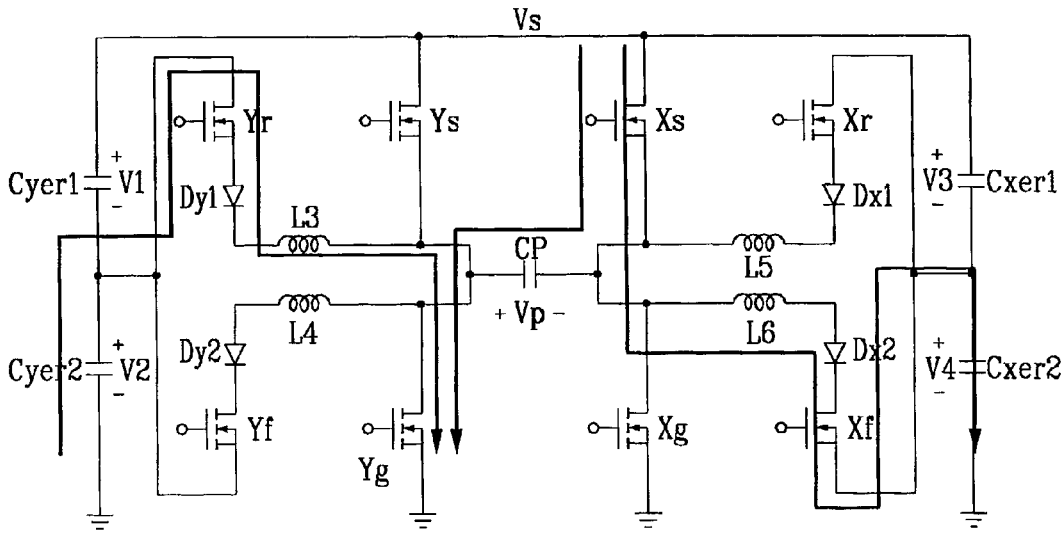
FIGS. 16A, 16B, 16C, 16D, 16E, 16F, 16G, and 16H illustrate the individual operation modes of the energy recovery circuit shown in FIG. 15.
Figure 16B:
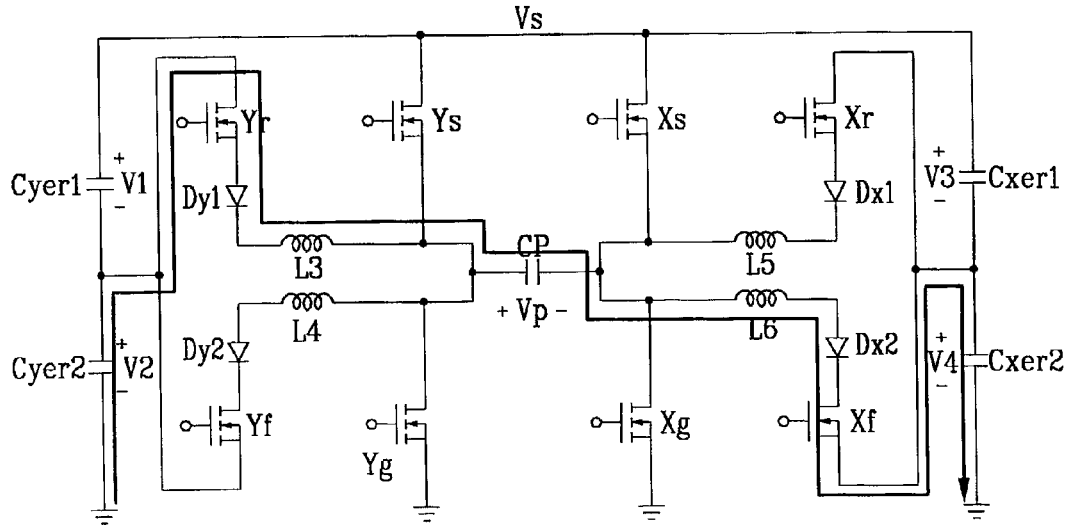
Figure 16C:
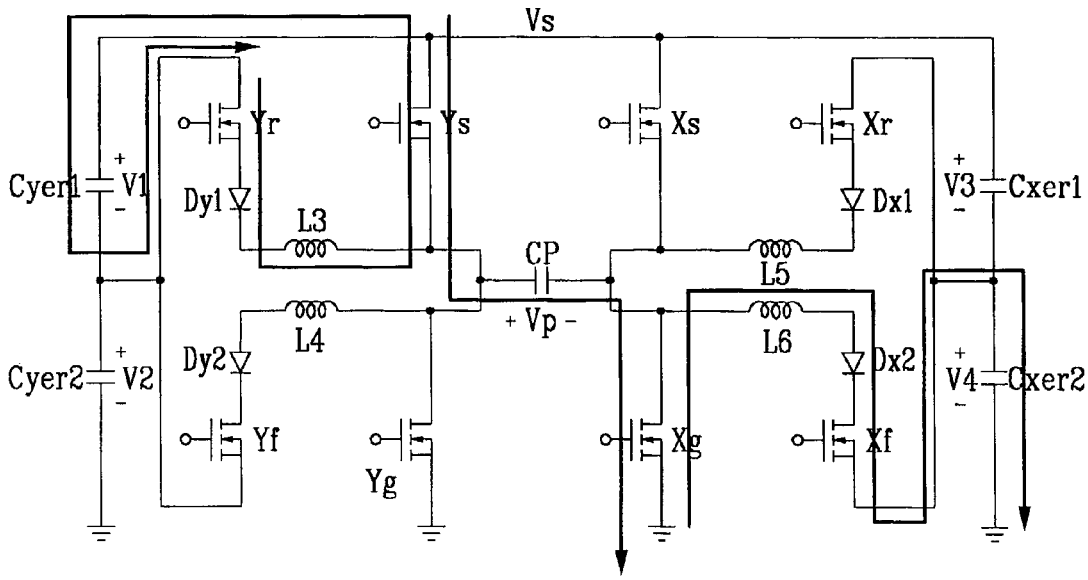
Figure 16D:
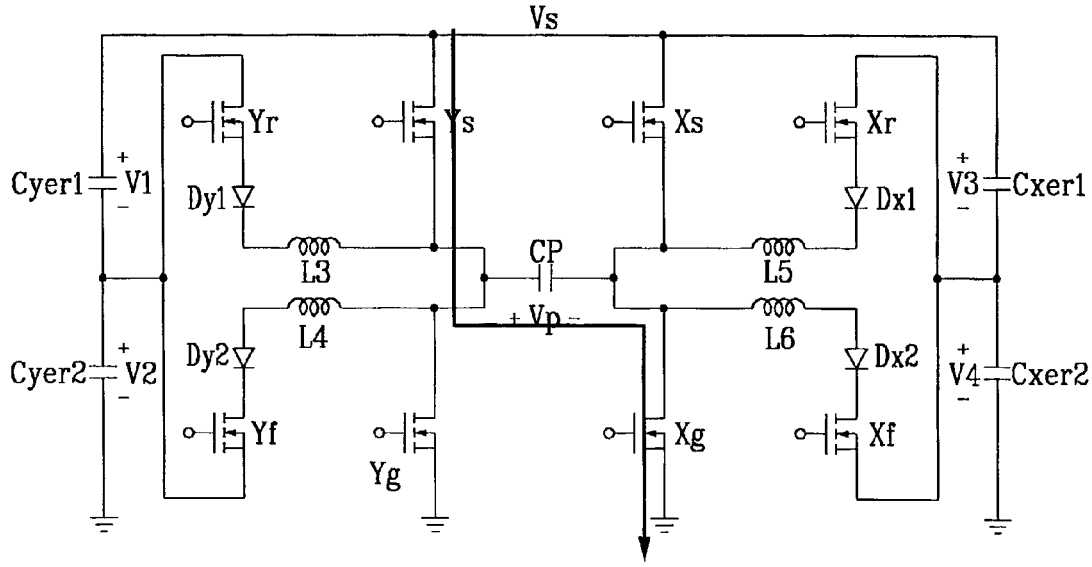
Figure 16E:
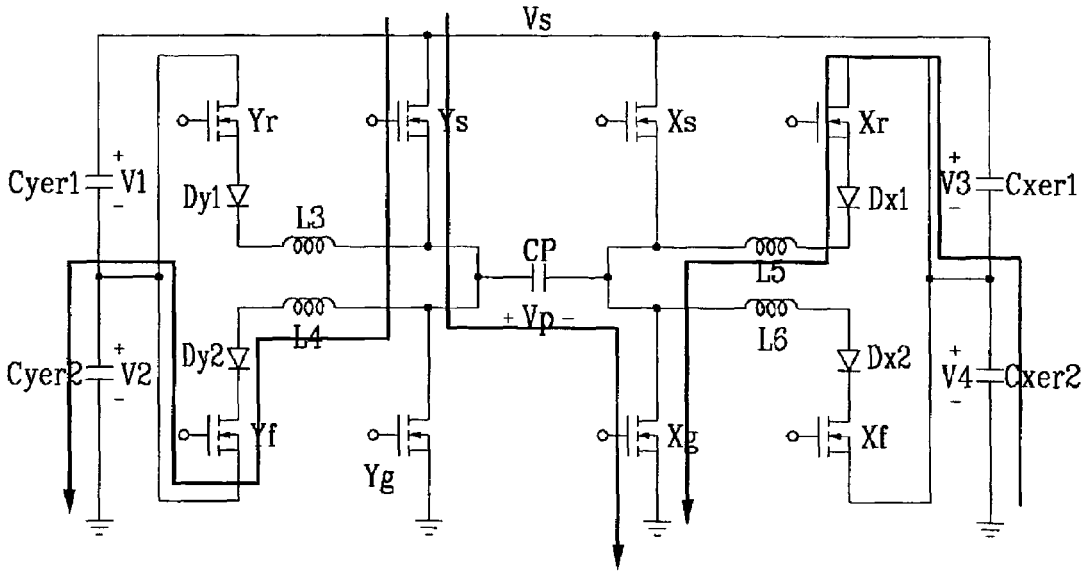
Figure 16F:
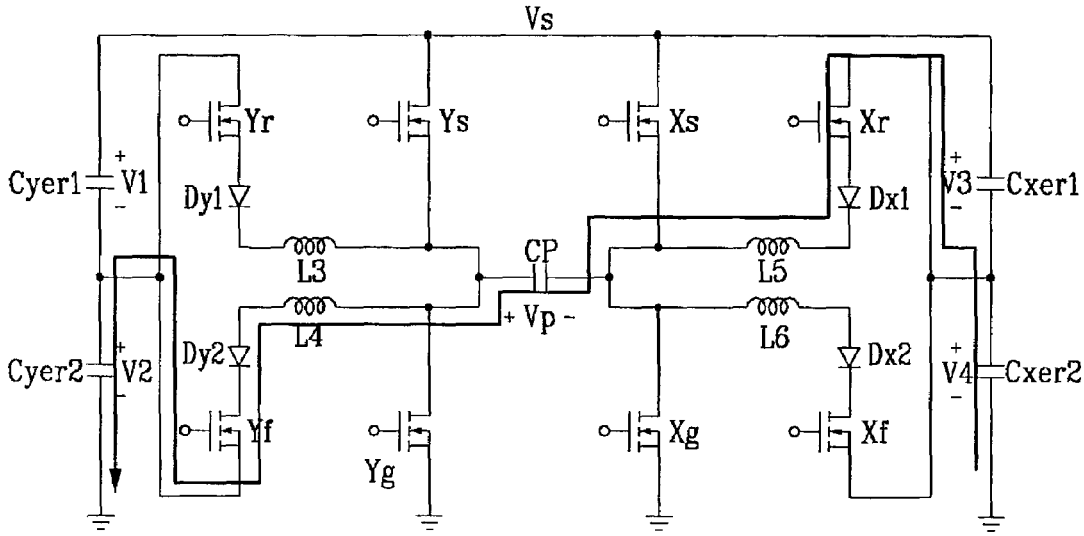
Figure 16G:
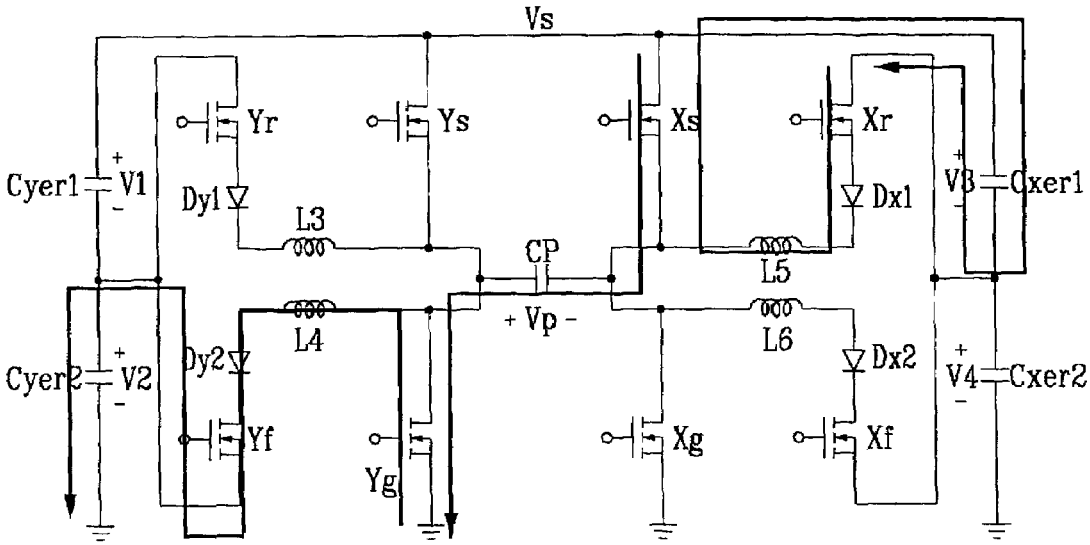
Figure 16H:
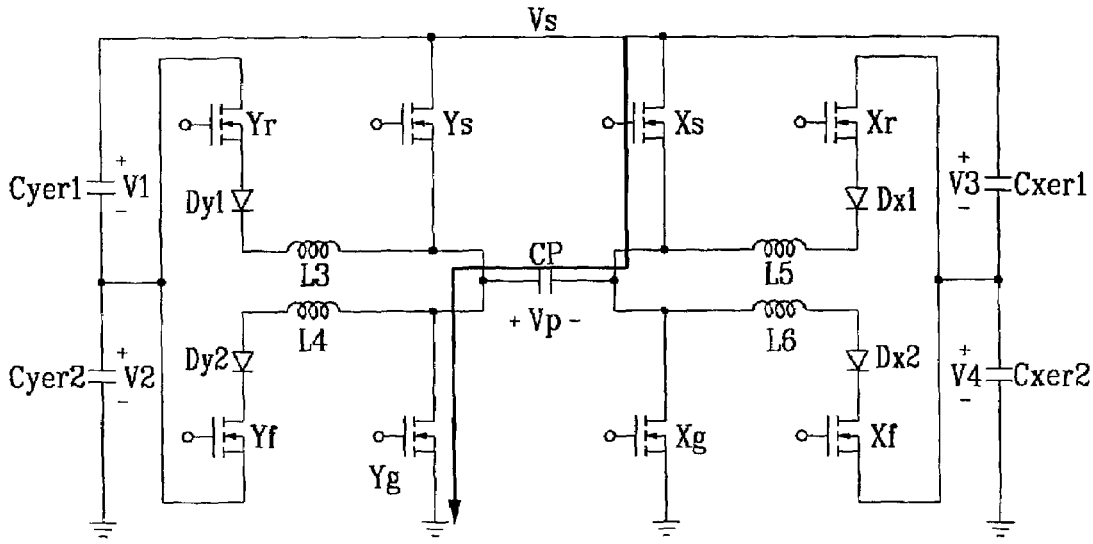

The energy recovery circuit shown in FIG. 14 according to the fourth embodiment of the present invention regulates the charging/discharging currents of the capacitors by controlling the values of the variable voltages $V_{yer2}$ and $V_{xer2}$ while fixing the intervals where the gate signals of the energy recovery switches $Y_r$, $Y_f$, $X_r$ and $X_f$ overlap those of the sustain switches $Y_s$, $Y_g$, $X_s$ and $X_g$, e.g., making the interval where the gate signals of the sustain switches $Y_s$ and $X_g$ overlap those of the energy recovery switches $Y_r$, $Y_f$, $X_r$ and $X_f$ equal to the interval where the gate signals of the sustain switches $X_s$ and $Y_g$ overlap those of the energy recovery switches $Y_r$, $Y_f$, $X_r$ and $X_f$.FIG. 15 illustrates an energy recovery circuit 360 according to a fifth embodiment of the present invention. Referring to FIG. 15, the energy recovery circuit 360 comprises a sustain discharge unit 362, a Y electrode charge/discharge unit 364, and an X electrode charge/discharge unit 366.

The sustain discharge unit 362, the Y electrode charge/discharge unit 364 and the X electrode charge/discharge unit 366 shown in FIG. 15 are quite similar in constituent components and operation to the sustain discharge unit 322, the Y electrode charge/discharge unit 324 and the X electrode charge/discharge unit 326 shown in FIG. 6. The difference is that the Y electrode charge/discharge unit 364 uses two inductors L3, L4 and the X electrode charge/discharge unit 366 uses two inductors L5, L6.

The Y electrode charge/discharge unit 324 and the X electrode charge/discharge unit 326 shown in FIG. 6 execute charging/discharging operation using energy stored in the single inductors L1, L2, respectively. The Y electrode charge/discharge unit 364 and the X electrode charge/discharge unit 366 shown in FIG. 15 execute charging operation using energy stored in the inductors L3, L5, respectively and execute discharging operation using energy stored in the inductors L4, L6, respectively FIGS. 16A through 16H illustrate the current paths formed in the respective operation modes according to the fifth embodiment of the present invention shown in FIG. 15. A further detailed explanation for FIGS. 16A through 16H will be omitted because its operation is similar to those explained previously and it can easily be understood by those skilled in the technical field related to the present invention.

In the Y electrode charge/discharge unit 364 and the X electrode charge/discharge unit 366 shown in FIG. 15, the inductance of Inductors L3, L5 for charging operation may be different from the inductance of Inductors L4, L6 for discharging operation such that charging time of panel capacitance $C_P$ may be different from the discharging time of panel capacitance.

According to the present invention, the required time ($\Delta T = t2 - t1$) for polarity inversion in the modes 2 and 6 can be calculated as follows.

Figure 17:
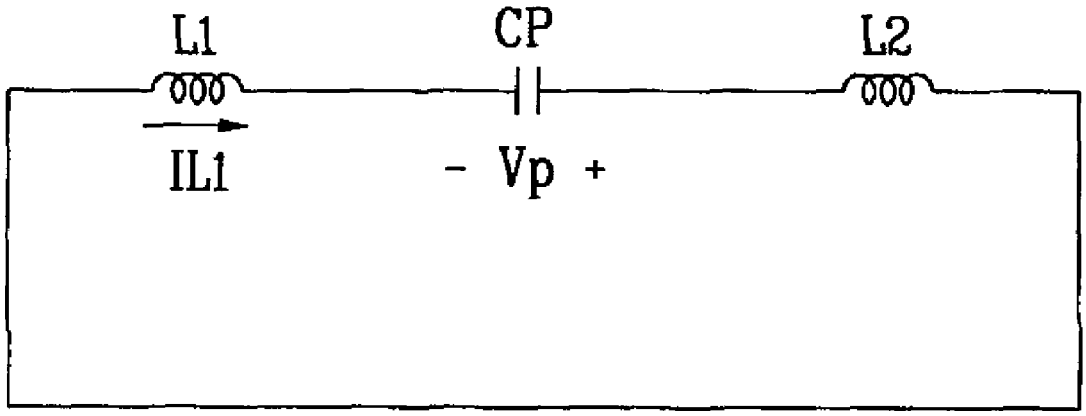
FIG. 17 illustrates the equivalent circuit of mode 2 in accordance with an embodiment of the present invention.

First, the circuit state in mode 2 is modeled as shown FIG. 17 in order to determine the required time $\Delta T$ for polarity inversion. It is assumed that L1=L2=L, and V2=V4=V. At t=t1, the inductor current $I_L$ and the terminal voltage $V_P$ of the panel capacitor are $I_{pk}$ and $V_S$, respectively.

The inductor current $I_{pk}$ is given by Equation 1:

$$I_{pk} = \frac{V}{L}\Delta T \qquad \text{[Equation 1]}$$

Based on this equivalent circuit, the required time $\Delta T$ for polarity inversion can be calculated as Equation 2:

$$\Delta T = \sqrt{LC}\left[\cos^{-1}\left\{\frac{-V_S}{\sqrt{V_S^2 + (ZI_{pk})^2}}\right\} - \tan^{-1}\frac{ZI_{pk}}{V_S}\right] \qquad \text{[Equation 2]}$$

where:

$$Z = \sqrt{\frac{L}{C_P}}$$

As seen from Equation 2, the values of the inductors and the energy recovery capacitors are set to determine the required time for polarity inversion in the embodiment of the present invention. Accordingly, an appropriate selection of inductors and the energy recovery capacitors can shorten the rising/falling time of the panel voltage so that the panel performs a discharge in a sustain discharge interval except for at the panel voltage rising/falling interval.

While this invention has been described in connection with what is presently considered to be the most practical and preferred embodiment, it is to be understood that the invention is not limited to the disclosed embodiments, but is intended to cover various modifications and equivalent arrangements included within the spirit and scope of the appended claims.

For example, although the energy recovery circuit according to the embodiment of the present invention is a driver circuit for a PDP, it may also be an energy recovery circuit of a device having a capacitive load as well.

The present invention is not limited to the scan electrode driver or to the sustain electrode driver. It can also be used for the address driver. Also, more than one inductor can be used. For example, one inductor is used for discharge and the other inductor is used for charge.

As described above, the present invention allows zero-voltage switching despite the parasitic components of the circuit and prevents an inrush current from occurring at the start of a sustain discharge. Also, the present invention shortens the rising/falling time of the panel voltage without increasing the current flowing to the driving device so that the panel performs a discharge in the sustain interval except for at the rising and falling intervals of the panel voltage. Furthermore, an input voltage is divided and charged into the energy recovery capacitors when the circuit starts to operate, to apply the divided internal voltage of the energy recovery switch during the initial operation and use the switch of a low internal voltage, thereby reducing the cost and increasing the efficiency.

What is claimed is:

1. An apparatus for driving a plasma display panel comprising a pair of a scan electrode and a sustain electrode alternately disposed and a panel capacitor formed between the scan electrode and the sustain electrode, said apparatus comprising:

a sustain discharge unit comprising a first switch and a second switch serially connected between a first voltage and a second voltage and having a first contact connected to one terminal of the panel capacitor, and a third switch and a fourth switch serially connected between the first voltage and the second voltage and having a second contact connected to another terminal of the panel capacitor, said sustain discharge unit maintaining either terminal voltage of the panel capacitor at the first voltage or the second voltage;

a first charge/discharge unit comprising a first capacitor and a second capacitor serially connected between the first voltage and the second voltage, a fifth switch and a sixth switch respectively connected in parallel to a contact between the first capacitor and the second capacitor, and a first inductor connected to a contact between the fifth switch and the sixth switch and to the one terminal of the panel capacitor, said first charge/discharge unit charging the one terminal of the panel capacitor to the first voltage or discharging it to the second voltage; and a second charge/discharge unit comprising a third capacitor and a fourth capacitor serially connected between the first voltage and the second voltage, a seventh switch and an eighth switch respectively connected in parallel to a contact between the third capacitor and the fourth capacitor, and a second inductor connected to a contact between the seventh switch and the eighth switch and to the other terminal of the panel capacitor, said second charge/discharge unit charging the other terminal of the panel capacitor to the first voltage or discharging it to the second voltage.

2. The apparatus as claimed in claim 1, wherein said first charge/discharge unit further comprises a first diode and a second diode respectively connected to the fifth switch and the sixth switch, for determining a path for current supply to the panel capacitor and a path for current recovery from the panel capacitor, wherein said second charge/discharge unit further comprises a third diode and a fourth diode respectively connected to the seventh switch and the eighth switch for determining a path for current supply to the panel capacitor and a path for current recovery from the panel capacitor.

3. The apparatus as claimed in claim 1, wherein each of the first switch through the fourth switch comprises a transistor having a body diode.

4. The apparatus as claimed in claim 1, wherein the first voltage is a sustain discharge voltage and the second voltage is a ground voltage.

5. The apparatus of claim 1, wherein resonance between the panel capacitor and the first and second inductors occurs by turning off the second switch and the third switch after the second switch, the third switch, the fifth switch, and the eighth switch are turned on.

6. The apparatus of claim 1, wherein resonance between the panel capacitor and the first and second inductors occurs by turning off the first switch and the fourth switch after the first switch, the fourth switch, the sixth switch, and the seventh switch are turned on.

7. An apparatus for driving a plasma display panel comprising a pair of a scan electrode and a sustain electrode alternately disposed and a panel capacitor formed between the scan electrode and the sustain electrode, said apparatus comprising:

a sustain discharge unit comprising a first switch and a second switch serially connected between a first voltage and a second voltage and having a first contact connected to the one terminal of the panel capacitor, and a third switch and a fourth switch serially connected between the first voltage and the second voltage and having a second contact connected to the other terminal of the panel capacitor, said sustain discharge unit maintaining either terminal voltage of the panel capacitor at the first voltage or the second voltage;

a first charge/discharge unit comprising a first capacitor and a first variable voltage serially connected between the first voltage and the second voltage, a fifth switch and a sixth switch respectively connected in parallel to a contact between the first capacitor and the first variable voltage, and a first inductor connected to a contact between the fifth switch and the sixth switch and to one terminal of the panel capacitor, said first charge/discharge unit charging the one terminal of the panel capacitor to the first voltage or discharging it to the second voltage; and a second charge/discharge unit comprising a second capacitor and a second variable voltage serially connected between the first voltage and the second voltage, a seventh switch and an eighth switch respectively connected in parallel to a contact between the second capacitor and the second variable voltage, and a second inductor connected to a contact between the seventh switch and the eighth switch and to the other terminal of the panel capacitor, said second charge/discharge unit charging another terminal of the panel capacitor to the first voltage or discharging it to the second voltage.

8. The apparatus as claimed in claim 7, wherein said first charge/discharge unit further comprises a first diode and a second diode respectively connected to the fifth switch and the sixth switch, for determining a path for current supply to the panel capacitor and a path for current recovery from the panel capacitor, wherein said second charge/discharge unit further comprises a third diode and a fourth diode respectively connected to the seventh switch and the eighth switch, for determining a path for current supply to the panel capacitor and a path for current recovery from the panel capacitor.

9. The apparatus as claimed in claim 7, wherein each of the first switch through the fourth switch comprises a transistor having a body diode.

10. The apparatus as claimed in claim 7, wherein the first voltage is a sustain discharge voltage and the second voltage is a ground voltage.

11. The apparatus of claim 7, wherein resonance between the panel capacitor and the first and second inductors occurs by turning off the second switch and the third switch after the second switch, the third switch, the fifth switch, and the eighth switch are turned on.

12. The apparatus of claim 7, wherein resonance between the panel capacitor and the first and second inductors occurs by turning off the first switch and the fourth switch after the first switch, the fourth switch, the sixth switch, and the seventh switch are turned on.

13. An apparatus for driving a plasma display panel comprising a pair of a scan electrode and a sustain electrode alternately disposed and a panel capacitor formed between the scan electrode and the sustain electrode, said apparatus comprising:

a sustain discharge unit comprising a first switch and a second switch serially connected between a first voltage and a second voltage and having a first contact connected to one terminal of the panel capacitor, and a third switch and a fourth switch serially connected between the first voltage and the second voltage and having a second contact connected to another terminal of the panel capacitor, said sustain discharge unit maintaining either terminal voltage of the panel capacitor at the first voltage or the second voltage; and a first inductor and a second inductor electrically connected to the one terminal and the other terminal of the panel capacitor, respectively;

a first charge/discharge unit comprising a first energy recovery capacitor and a second energy recovery capacitor serially connected between the first voltage and the second voltage, for energy supply to the panel capacitor or energy recovery from the panel capacitor, and a fifth switch and a sixth switch respectively connected in parallel between the first inductor and a contact between the first energy recovery capacitor and the second energy recovery capacitor, for performing a switching operation to raise the one terminal voltage of the panel capacitor to the first voltage or drop it to the second voltage;

a second charge/discharge unit comprising a third energy recovery capacitor and a fourth energy recovery capacitor serially connected between the first voltage and the second voltage, for energy supply to the panel capacitor or energy recovery from the panel capacitor, and a seventh switch and an eighth switch respectively connected in parallel between the second inductor and a contact between the third energy recovery capacitor and the fourth energy recovery capacitor, for performing a switching operation to raise the other terminal voltage of the panel capacitor to the first voltage or drop it to the second voltage;

wherein said charge/discharge units boost a current to store an energy in the first inductor and the second inductor while either terminal voltage of the panel capacitor is maintained at a sustain discharge voltage, and invert the polarity of either terminal voltage of the panel capacitor using the energy stored in the first inductor and the second inductor and resonance between the panel capacitor and the first and second inductors.

14. The apparatus as claimed in claim 13, wherein each of the first switch through the fourth switch comprises a transistor having a body diode.

15. The apparatus as claimed in claim 14, wherein said charge/discharge unit performs zero-voltage switching of the first switch through the fourth switch using the energy stored in the first inductor and the second inductor after inverting the polarity of either terminal voltage of the panel capacitor.

16. The apparatus as claimed in claim 13, wherein the first voltage is a sustain discharge voltage and the second voltage is a ground voltage.

17. A plasma display panel, comprising:

a panel comprising a plurality of address electrodes, a plurality of a pair of a scan electrode and a sustain electrode alternately arranged , and a panel capacitor formed between the scan electrode and the sustain electrode;

a controller for receiving an external image signal, and generating an address drive control signal and a sustain discharge signal;

an address driver that receives the address drive control signal from the controller and applies a display data signal to the address electrode; and a scan/sustain driver that receives the sustain discharge signal from the controller and applies a sustain discharge voltage alternately to the scan electrodes and the sustain electrodes, wherein said scan/sustain driver comprises:

a sustain discharge unit comprising a first switch and a second switch serially connected between a first voltage and a second voltage and having a first contact connected to the one terminal of the panel capacitor, and a third switch and a fourth switch serially connected between the first voltage and the second voltage and having a second contact connected to the other terminal of the panel capacitor, the sustain discharge unit maintaining either terminal voltage of the panel capacitor at the first voltage or the second voltage; and a charge/discharge unit comprising a first inductor and a second inductor electrically connected to the one terminal and the other terminal of the panel capacitor, respectively, the charge/discharge unit boosting a current to a predetermined level for a later sustain discharge to store an energy in the first inductor and the second inductor while either terminal voltage of the panel capacitor is maintained at the sustain discharge voltage, the charge/discharge unit inverting the polarity of either terminal voltage of the panel capacitor using the energy stored in the first inductor and the second inductor and resonance between the panel capacitor and the first and second inductors, wherein the charge/discharge unit further comprises a first energy recovery capacitor and a second energy recovery capacitor serially connected between the first voltage and the second voltage, for energy supply to the panel capacitor or energy recovery from the panel capacitor.

18. The plasma display panel as claimed in claim 17, wherein each of the first switch through the fourth switch comprises a transistor having a body diode.

19. The plasma display panel as claimed in claim 18, wherein the charge/discharge unit performs zero-voltage switching of the first switch through the fourth switch using the energy stored in the first inductor and the second inductor after inverting the polarity of either terminal voltage of the panel capacitor.

20. A method for driving a plasma display panel comprising a pair of a scan electrode and a sustain electrode alternately disposed and a panel capacitor formed between the scan electrode and the sustain electrode, said method comprising steps of:

boosting a current flowing to both a first inductor electrically connected to one terminal and to a second inductor electrically connected to another terminal of the panel capacitor, to store an energy in the first inductor and the second inductor, while both terminal voltages of the panel capacitor are maintained at a sustain discharge voltage having a first polarity;

inverting the polarity of both terminal voltages of the panel capacitor using the energy stored in the first inductor and the second inductor and resonance between the panel capacitor and the first and second inductors; and maintaining both terminal voltages of the panel capacitor at the sustain discharge voltage having the second polarity, wherein the first inductor and the second inductor still contain energy, even after the panel capacitor is fully charged.

21. The method of claim 20, further comprising a step of recovering the energy stored in the first inductor and the second inductor while both terminal voltages of the panel capacitor are changed to a sustain discharge voltage having a second polarity opposite to the first polarity.

22. The method as claimed in claim 20, wherein the plasma display panel comprises:

a sustain discharge unit comprising a first switch and a second switch serially connected between a first voltage and a second voltage and having a contact connected to the one terminal of the panel capacitor, and a third switch and a fourth switch serially connected between the first voltage and the second voltage and having a contact connected to the other terminal of the panel capacitor, the sustain discharge unit maintaining a terminal voltage of the panel capacitor at the first voltage or the second voltage;

wherein a step of recovering energy comprises performing zero-voltage switching of the first switch through the fourth switch using the energy stored in the first inductor and the second inductor after both terminal voltages of the panel capacitor are changed to the sustain discharge voltage having the second polarity.

23. A method for driving a plasma display panel having an apparatus for driving a plasma display panel comprising a pair of a scan electrode and a sustain electrode alternately disposed and a panel capacitor formed between the scan electrode and the sustain electrode, comprising: a sustain discharge unit comprising a first switch and a second switch serially connected between a first voltage and a second voltage and having a first contact connected to one terminal of the panel capacitor, and a third switch and a fourth switch serially connected between the first voltage and the second voltage and having a second contact connected to another terminal of the panel capacitor, said sustain discharge unit maintaining either terminal voltage of the panel capacitor at the first voltage or the second voltage; a first charge/discharge unit comprising a first capacitor and a second capacitor serially connected between the first voltage and the second voltage, a fifth switch and a sixth switch respectively connected in parallel to a contact between the first capacitor and the second capacitor, and a first inductor connected to a contact between the fifth switch and the sixth switch and to the one terminal of the panel capacitor, said first charge/discharge unit charging the one terminal of the panel capacitor to the first voltage or discharging it to the second voltage; and a second charge/discharge unit comprising a third capacitor and a fourth capacitor serially connected between the first voltage and the second voltage, a seventh switch and an eighth switch respectively connected in parallel to a contact between the third capacitor and the fourth capacitor, and a second inductor connected to a contact between the seventh switch and the eighth switch and to the other terminal of the panel capacitor, said second charge/discharge unit charging the other terminal of the panel capacitor to the first voltage or discharging it to the second voltage, said method comprising steps of:

turning the second and third switches ON, and maintaining the one terminal voltage of the panel capacitor to the second voltage and the other terminal of the panel capacitor to the first voltage;

turning the fifth and eighth switches ON while the second switch and the third switch are ON, and storing an energy in the first inductor and the second inductor;

turning the second switch and the third switch OFF while the fifth switch and the eighth switch are ON, and inverting the polarity of both terminal voltage of the panel capacitor;

turning the first switch and the fourth switch ON while the fifth switch and the eighth switch are ON, and recovering the energy stored in the first inductor and the second inductor; and turning the fifth switch and the eighth switch OFF while the first switch and the fourth switch are ON, and maintaining the one terminal voltage of the panel capacitor at the first voltage and the other terminal of the panel capacitor at the second voltages.

24. The method as claimed in claim 23, wherein an interval where the second switch and the third switch are ON simultaneously with the fifth switch is equal to an interval where the second switch and the third switch are ON simultaneously with the eighth switch.

25. The method as claimed in claim 23, wherein an interval where the second switch and the third switch are ON simultaneously with the fifth switch is longer than an interval where the second switch and the third switch are ON simultaneously with the eighth switch.

26. The method as claimed in claim 23, wherein an interval where the second switch and the third switch are ON simultaneously with the fifth switch is shorter than an interval where the second switch and the third switch are ON simultaneously with the eighth switch.

27. A method for driving a plasma display panel, having a panel capacitor with a terminal, and at least one inductor electrically coupled to the terminal, comprising steps of:

applying a current of a first polarity to the inductor while holding the terminal at a first voltage level in order to store first energy in the inductor;

changing the panel capacitor terminal voltage level to a second voltage level using the first energy stored in the inductor;

applying a current of a second polarity opposite to the first polarity to the at least one inductor while holding the terminal at the second voltage level in order to store second energy in one of the inductor or a second inductor electrically coupled to the terminal; and discharging the capacitor terminal voltage from the second voltage level to the first voltage level using the second energy stored in one of the inductor or the second inductor and resonance between the panel capacitor and the inductor.

28. The method of claim 27, wherein the inductor or the second inductor containing the second energy still contains energy, even after the terminal voltage is changed to the second voltage level.

29. The method of claim 28, further comprising a step of:

recovering the remaining energy from the inductor or the second inductor when the terminal voltage level is changed to the second voltage level.

30. The method of claim 29, further comprising a step of:

supplying continuously to the capacitor the second voltage level from an external source after the terminal voltage level is changed to the second voltage level.

31. An apparatus for driving a plasma display panel comprising a pair of a scan electrode and a sustain electrode alternately disposed and a panel capacitor formed between the scan electrode and the sustain electrode, said apparatus comprising:

a sustain discharge unit comprising a first switch and a second switch serially connected between a first voltage and a second voltage and having a first contact connected to one terminal of the panel capacitor, and a third switch and a fourth switch serially connected between the first voltage and the second voltage and having a second contact connected to another terminal of the panel capacitor, said sustain discharge unit maintaining either terminal voltage of the panel capacitor at the first voltage or the second voltage; and a first inductor and a second inductor electrically connected to the one terminal and the other terminal of the panel capacitor, respectively;

a first charge/discharge unit comprising a first capacitor and a first variable voltage serially connected between the first voltage and the second voltage, and a fifth switch and a sixth switch respectively connected in parallel between the first inductor and a contact between the first capacitor and the first variable voltage, said first charge/discharge unit charging the one terminal of the panel capacitor to the first voltage or discharging it to the second voltage;

a second charge/discharge unit comprising a second capacitor and a second variable voltage serially connected between the first voltage and the second voltage, and a seventh switch and an eighth switch respectively connected in parallel between the second inductor and a contact between the second capacitor and the second variable voltage, said second charge/discharge unit charging the other terminal of the panel capacitor to the first voltage or discharging it to the second voltage;

wherein said charge/discharge units boost a current to store an energy in the first inductor and the second inductor while either terminal voltage of the panel capacitor is maintained at a sustain discharge voltage, and invert the polarity of either terminal voltage of the panel capacitor using the energy stored in the first inductor and the second inductor and resonance between the panel capacitor and the first and second inductors.

* * * * *